US006885135B2

(12) United States Patent
Kanao et al.

(10) Patent No.: US 6,885,135 B2
(45) Date of Patent: Apr. 26, 2005

(54) SPARK PLUG AND ITS MANUFACTURING METHOD

(75) Inventors: Keiji Kanao, Aichi-ken (JP); Tsunenobu Hori, Kariya (JP)

(73) Assignee: Denso Corporation (JP)

( * ) Notice: Subject to any disclaimer, the term of this patent is extended or adjusted under 35 U.S.C. 154(b) by 8 days.

(21) Appl. No.: 10/097,929

(22) Filed: Mar. 15, 2002

(65) Prior Publication Data

US 2002/0130602 A1 Sep. 19, 2002

(30) Foreign Application Priority Data

Mar. 16, 2001 (JP) ..... 2001-076960
Oct. 16, 2001 (JP) ..... 2001-318471
Dec. 3, 2001 (JP) ..... 2001-369029

(51) Int. Cl.[7] ..... H01T 13/20
(52) U.S. Cl. ..... 313/141; 445/7; 123/169 EL
(58) Field of Search ..... 313/140, 141, 313/143, 118; 445/7; 123/153, 169 EL, 163

(56) References Cited

U.S. PATENT DOCUMENTS 4,742,265 A * 5/1988 Giachino et al. ..... 313/141
4,881,913 A * 11/1989 Mann ..... 445/7
4,904,216 A * 2/1990 Kagawa et al. ..... 445/7
5,558,575 A * 9/1996 Chiu et al. ..... 445/7
6,412,465 B1 * 7/2002 Lykowski et al. .... 123/169 EL
6,472,801 B1 * 10/2002 Matsubara et al. ..... 313/141
6,597,089 B1 * 7/2003 Matsutani ..... 313/141
6,603,244 B1 * 8/2003 Sugiyama et al. ..... 313/118
6,611,084 B1 * 8/2003 Teramura et al. ..... 313/141

FOREIGN PATENT DOCUMENTS

| | | |
|---|---|---|
| JP | 59-47436 | 11/1984 |
| JP | 4-32180 | 2/1992 |
| JP | 4-366580 | 12/1992 |
| JP | 05-242952 | 9/1993 |
| JP | 2000-336446 | 12/2000 |

* cited by examiner

*Primary Examiner*—Edward J. Glick
*Assistant Examiner*—Elizabeth Keaney
(74) *Attorney, Agent, or Firm*—Nixon & Vanderhye PC

(57) ABSTRACT

Noble metallic tips, made of a Pt alloy or an Ir alloy, are fixed to electrode base materials. The electrode base materials are an alloy containing a chief element selected from the group consisting of Ni, Fe, and Co and a plurality of additive elements. At least two kinds of additive elements contained in this alloy have a standard free energy of formation smaller than that of the chief element.

21 Claims, 15 Drawing Sheets

FIG. 4

| | | COMPOSITION OF NI-BASE ALLOY (WEIGHT %) | | | | | | EVALUATION | | |
|---|---|---|---|---|---|---|---|---|---|---|
| | | Cr | Aℓ | Si | Mn | Fe | Ni+IMPURITIES | WORKABILITY | OXIDATION RESISTIVITY | TIP BONDABILITY |
| TESTED ELECTRODE BASE MATERIALS | No 1 | 4.1 | 0.1 | 0.22 | 0.15 | 7.7 | REMAINDER | ○ | × | × |
| | No 2 | 3.9 | 3.2 | 0.20 | 0.18 | 7.5 | REMAINDER | ○ | × | × |
| | No 3 | 8.2 | 0.1 | 0.18 | 0.25 | 8.2 | REMAINDER | ○ | × | × |
| | No 4 | 8.4 | 2.9 | 0.21 | 0.22 | 8.0 | REMAINDER | ○ | × | × |
| | No 5 | 10.5 | 0.2 | 0.20 | 0.15 | 7.4 | REMAINDER | ○ | ○ | × |
| | No 6 | 10.1 | 3.0 | 0.18 | 0.20 | 7.6 | REMAINDER | ○ | ○ | ○ |
| | No 7 | 11.9 | 0.1 | 0.14 | 0.15 | 8.0 | REMAINDER | ○ | ○ | × |
| | No 8 | 12.1 | 3.1 | 0.20 | 0.17 | 7.9 | REMAINDER | ○ | ○ | ○ |
| | No 9 | 12.1 | 5.0 | 0.18 | 0.30 | 8.6 | REMAINDER | ○ | ○ | × |
| | No 10 | 15.0 | 0.1 | 0.23 | 0.22 | 8.1 | REMAINDER | ○ | ○ | × |

FIG. 5

| | | COMPOSITION OF NI-BASE ALLOY (WEIGHT %) | | | | | | EVALUATION | | |
|---|---|---|---|---|---|---|---|---|---|---|
| | | Cr | Aℓ | Si | Mn | Fe | Ni+IMPURITIES | WORKABILITY | OXIDATION RESISTIVITY | TIP BONDABILITY |
| TESTED ELECTRODE BASE MATERIALS | No 11 | 15.4 | 0.1 | 2.20 | 0.22 | 8.1 | REMAINDER | ○ | ○ | × |
| | No 12 | 15.2 | 0.8 | 0.20 | 0.23 | 7.9 | REMAINDER | ○ | ○ | × |
| | No 13 | 15.5 | 1.5 | 0.18 | 0.18 | 7.9 | REMAINDER | ○ | ○ | ○ |
| | No 14 | 16.1 | 2.1 | 0.20 | 0.17 | 7.8 | REMAINDER | ○ | ○ | ○ |
| | No 15 | 15.4 | 2.5 | 2.15 | 0.24 | 8.1 | REMAINDER | ○ | ○ | ○ |
| | No 16 | 15.8 | 2.9 | 0.17 | 0.24 | 8.1 | REMAINDER | ○ | ○ | ○ |
| | No 17 | 15.7 | 4.0 | 0.23 | 0.27 | 7.5 | REMAINDER | ○ | ○ | ○ |
| | No 18 | 15.5 | 5.0 | 0.16 | 0.19 | 7.2 | REMAINDER | ○ | ○ | ○ |
| | No 19 | 16.1 | 6.1 | 0.18 | 0.28 | 7.6 | REMAINDER | × | —— | —— |
| | No 20 | 19.7 | 3.1 | 0.20 | 0.33 | 7.1 | REMAINDER | ○ | ○ | ○ |
| | No 21 | 23.1 | 2.6 | 0.21 | 0.12 | 7.7 | REMAINDER | × | —— | —— |
| CONVENTIONAL EXAMPLE | | 15.7 | 0.1 | 0.23 | 0.16 | 8.1 | REMAINDER | ○ | ○ | × |

SPARK PLUG AND ITS MANUFACTURING METHOD

BACKGROUND OF THE INVENTION

This invention relates to a spark plug having a center electrode, a ground electrode, and a noble metallic tip fixed to an electrode base material serving as at least one of the center electrode and the ground electrode. The spark plug of this invention is preferably applicable to an internal combustion engine installed in an automotive vehicle, a cogeneration system, and a pressurized gas feeding pump, or the like.

Generally, a spark plug used for an internal combustion engine has a center electrode, an insulator for holding this center electrode, a housing for fixedly holding this insulator, and a ground electrode having a proximal portion fixed to the housing and a distal portion opposing the center electrode. To meet the high performance of recent engines or to realize a maintenance free, assuring long life of spark plug is earnestly required nowadays. To this end, a noble metallic tip is fixed to each apical end (i.e., a spark discharge portion) of the center electrode and the ground electrode.

In this case, due to difference in the thermal expansion coefficient between the electrode base material and the noble metallic tip, a significant thermal stress acts on a joint area between the electrode base material and the noble metallic tip. Recent engines are subjected to severe exhaust gas purification and employ a lean burn combustion technique. Electrodes of a spark plug are exposed to high-temperature combustion. Rapidly increasing and decreasing the plug temperature will cause a severe thermal load acting on the joint area of the electrode base material and the noble metallic tip.

The thermal stress acting in an outer peripheral region of a tip is large. The larger the thermal stress, the faster the oxidation advances from the outer periphery toward the center of the tip. In other words, the margin of joint (or bond) reliability becomes so small that the noble metallic tip may fall or peel off the electrode base material. To relax the thermal stress, Japanese patent No. 59-47436 discloses a relaxing layer capable of bringing the diffusion effect in the thermal treatment.

However, according to the above-described conventional manufacturing method, the cost will increase due to addition of a thermal treatment. In view of this problem, it may be desirable to select the materials having similar thermal expansion coefficients for the electrode base material and the noble metallic tip. However, this method includes the following problems.

For example, if a noble metallic tip is made of a material having a thermal expansion coefficient similar to that of an electrode base material, it will be necessary to add a large amount of additives, such as Ni, to a noble metal. This will worsen the anti-exhaustion properties of a noble metallic tip and therefore cannot assure a satisfactory life of a spark plug.

On the contrary, if an electrode base material is made of a material having a thermal expansion coefficient similar to that of a noble metallic tip, the electrode base material will need to contain an element having a small thermal expansion coefficient, such as W or Mo. This will worsen the bendability (i.e., workability) of an electrode base material. Such a material cannot be used for a spark plug.

SUMMARY OF THE INVENTION

In view of the above-described problems, the present invention has an object to provide a spark plug capable of assuring satisfactory anti-exhaustion properties of a noble metallic tip as well as satisfactory workability of an electrode base material, and also capable of assuring an excellent bonding strength between the noble metallic tip and the electrode base material.

To accomplish the above and other related objects, the inventors of this application have worked on the research and development focused in the electrode base materials. During an engine operation, all of the electrode elements of a spark plug cause chemical reactions with oxygen and form the oxides more or less. The state of each oxidized element is dependent on a standard free energy of formation, an additive amount, or the like. Therefore, the inventors have conducted the experiments to evaluate various compositions of electrode base materials.

According the experimental result, it is confirmed that adding two or more additive elements each having a standard free energy of formation (required for forming an oxide, in this case) smaller than that of a chief element is effective to steadily form an oxide film of one additive element (i.e., surficial oxide layer) on the surface of an electrode base material and also steadily form an oxide of other kind of additive element (i.e., inner oxide layer) beneath this oxide film.

When the surficial oxide film is steadily formed on the surface of an electrode base material, no oxidative reaction advances inward the electrode base material. Furthermore, the inner oxide layer steadily residing in the outer peripheral region of the noble metallic tip makes it possible to decrease the thermal expansion coefficient difference between the electrode base material and the noble metallic tip in this region. Thus, it becomes possible to reduce a thermal stress appearing in the outer peripheral region of the noble metallic tip and also suppress the oxidative reaction advancing from outer peripheral region, thereby assuring an excellent joint or bond strength between the noble metallic tip and the electrode base material. The present invention is derived through such experimental analysis.

More specifically, the present invention provides a first spark plug comprising a center electrode, an insulator for holding the center electrode, a housing for fixedly holding the insulator, a ground electrode having a proximal portion fixed to the housing and a distal portion opposing the center electrode, and a noble metallic tip fixed to an electrode base material serving as at least one of the center electrode and the ground electrode. The first spark plug is characterized in that the electrode base material is an alloy containing a chief element selected from the group consisting of nickel (Ni), iron (Fe), and cobalt (Co) and a plurality of additive elements, and at least two kinds of additive elements contained in the alloy have a standard free energy of formation smaller than that of the chief element.

According to this arrangement, the additive element contained in the electrode base material has a standard free energy of formation smaller than that of the chief element. Therefore, the additive element has an oxygen affinity larger than that of the chief element. In other words, the additive element contained in the electrode base material has a large tendency to turn into its oxide compared with the chief element. Thus, the additive element contained in the electrode base material easily oxidizes (i.e., easily turns into an oxide layer) on the surface of the electrode base material.

Adding two kinds of additive elements having such properties into an electrode base material makes it possible to steadily form a surficial oxide film on the surface of this electrode base material as well as an inner oxide layer positioned beneath this surficial oxide film as demonstrated by the experiments conducted by the inventors.

Accordingly, the present invention suppresses the oxidation of an inside portion of the electrode base material and therefore secures heat and oxidation resistance properties which are fundamentally required as the electrode base material. Furthermore, the present invention reduces a thermal stress acting on the boundary of the electrode base material and an outer peripheral region of the noble metallic tip, and suppresses the oxidation advancing from the outer peripheral region toward the inside of the electrode base material. Thus, the bonding or joint strength between the electrode base material and the noble metallic tip can be greatly increased.

Furthermore, formation of the surficial oxide film and the inner oxide layer gradually advances in accordance with the use of engine. Therefore, if an additive amount of each additive element is adequately adjusted, there will be no problem in the initial working or machining condition for the electrode base material. Furthermore, there is no necessity of changing the composition of noble metallic tip. This makes it possible to adequately maintain the anti-exhaustion properties of the noble metallic tip.

Accordingly, the present invention provides a spark plug capable of assuring satisfactory anti-exhaustion properties of the noble metallic tip as well as satisfactory workability of the electrode base material, and also capable of assuring an excellent bonding strength between the noble metallic tip and the electrode base material.

According to a preferred embodiment of the present invention, it is preferable that the chief element of the electrode base material is nickel so that the electrode base material can be constituted by a Ni-base alloy having excellent high-temperature strength and heat and oxidation resistance properties.

Furthermore, the inventors have experimentally confirmed that, among two or more kinds of additive elements, an additive element having a relatively higher standard free energy of formation has a strong tendency to form a surficial oxide film and an additive element having a relatively smaller standard free energy of formation tends to form an inner oxide layer.

An additive element having a larger standard free energy of formation is highly resistive against the oxidation compared with an additive element having a smaller standard free energy of formation. The surface of the electrode base material is exposed to an oxygen atmosphere. Thus, it is believed that the additive element having a larger standard free energy of formation tends to oxidize on the surface of the electrode base material rather than inside the electrode base material.

In view of the above, it is preferable that the electrode base material contains at least two kinds of additive elements having a mutually different standard free energy of formation. The additive element having a larger standard free energy of formation forms a rigid surficial oxide film, while the additive element having a smaller standard free energy of formation forms an inner oxide layer.

Especially, when a spark plug is used in a high-temperature range from 1,000° C. to 1,100° C., the spark plug must have sufficient endurance with respect to the heat resistance of the electrode base material as well as the bonding strength between the electrode base material and the noble metallic tip. In this respect, the present invention is preferably applicable to a spark plug used in such a high-temperature environment.

More specifically, it is preferable that the elements of the electrode base material satisfy the following relationships, $$E1<1.2\times E0 \text{ and } E2<1.2\times E1$$

wherein E0 represents a standard free energy of formation of the chief element at a temperature range from 1,000° C. to 1,100° C., E1 represents a standard free energy of formation of one kind of additive element at the temperature range from 1,000° C. to 1,100° C., and E2 represents a standard free energy of formation of at least one other additive element at the temperature range from 1,000° C. to 1,100° C.

Using two kinds of additive elements satisfying the relationships $E1<1.2\times E0$ and $E2<1.2\times E1$ is preferable to realize that, in a spark plug used in a high-temperature range from 1,000° C.to 1,100° C., the additive element having a relatively higher standard free energy of formation E1 forms the surficial oxide film while the additive element having a relatively smaller standard free energy of formation E2 forms the inner oxide layer.

An experimental research further conducted by the inventors has revealed that desirable result is obtained when an additive amount of the additive element having a larger standard free energy of formation E1 at the temperature range from 1,000° C. to 1,100° C. is three times or above the additive amount of individual additive element having a smaller standard free energy of formation E2 at the temperature range from 1,000° C. to 1,100° C. The additive element having a higher standard free energy of formation E1 promptly oxidizes and steadily forms a surficial oxide film on the surface of the electrode base material when compared with individual additive element having a smaller standard free energy of formation E2.

The first spark plug of the invention is derived from such research. Namely, it is preferable that an additive amount of the additive element having a standard free energy of formation E2 is equal to or larger than 1.5 weight %, and an additive amount of the additive element having the standard free energy of formation E1 is at least three times an additive amount of individual additive element having the standard free energy of formation E2.

This is preferable to adequately realize the effects of the present invention. Furthermore, by adjusting the additive amount of the additive element having a standard free energy of formation E2 to 1.5 weight %, the additive element having a standard free energy of formation E2 can surely form an inner oxide layer capable of reducing a thermal stress.

Furthermore, it is desirable that the additive element having the standard free energy of formation E1 includes chromium (Cr). It is also desirable that the additive element having the standard free energy of formation E2 includes aluminum (Al).

In this case, the chief element of the electrode base material is Ni whose standard free energy of formation E0 is −60 kcal at 1,000° C. Meanwhile, a standard free energy of formation E1 of Cr is −120 kcal. A standard free energy of formation E2 of Al is −200 kcal. These data satisfy the above relationship for the standard free energy of formation.

When an electrode base material contains a combination of additive elements Cr and Al, and when an additive amount of Al is equal to or larger than 1.5 weight % and an additive amount of Cr is at least three times the additive amount of Al, the bonding strength can be enhanced.

In this case, an aluminum oxide serving as the inner oxide layer deposits in an electrode base material and forms a composite layer consisting of the electrode base material and the aluminum oxide. The aluminum oxide has a relatively small thermal expansion coefficient. An overall thermal expansion coefficient of this composite layer is smaller than the thermal expansion coefficient of the electrode base material itself and closer to the thermal expansion coefficient of the noble metallic tip. Accordingly, it becomes possible to relax a thermal stress acting on the boundary of the electrode base material and an outer peripheral region of the noble metallic tip and suppress the oxidative reaction advancing from the outer peripheral region toward the inside of the electrode base material. Thus, the bonding or joint strength between the electrode base material and the noble metallic tip can be improved.

When the electrode base material contains a combination of additive elements Cr and Al, it is preferable that an additive amount of Cr is in a range from 10 to 20 weight % and an additive amount of Al is in a range from 1.5 to 5.5 weight %. This improves the workability of the electrode base material and also enhances the bonding strength between the electrode base material and the noble metallic tip. Furthermore, it is more preferable that the additive amount of Al is in a range from 2.2 to 5.0 weight %.

Regarding the additive amount range of Cr, the above-defined lower limit is an additive amount necessary to form the surficial oxide film and the above-defined upper limit is an additive amount necessary to assure the workability of the electrode base material. Regarding the additive amount range of Al, the above-defined lower limit is an additive amount necessary to relax thermal stress and the above-defined upper limit is an additive amount necessary to assure the workability of the electrode base material.

Furthermore, in the first spark plug of the present invention, it is preferable that the electrode base material contains Fe whose additive amount is larger than the additive amount of Al. Although the workability of the electrode base material deteriorates a little bit, adding Fe is effective to improve the workability of the electrode base material.

Furthermore, it is preferable that a total amount of elements other than the chief element, Cr. and Al is equal to or less than 20 weight %. In the first spark plug of the present invention, adding the elements other than the chief element, Cr, and Al is effective to improve the deoxidizing and forging properties. No adverse influence is given when the total amount of the elements other than the chief element, Cr, and Al is suppressed to 20 weight % or less.

Furthermore, according to the inventors, adding Al to an electrode base material possibly increases the hardness of the electrode base material and therefore worsens the workability. Hence, when a bending work is applied to the ground electrode to form a discharge gap, springback of the ground electrode becomes large with increasing hardness of the electrode base material. This will deteriorate the accuracy in the formation of the discharge gap.

This problem can be solved by lowering the hardness of the electrode base material. In this case, a key to solve this problem is the hardness of the portion of the electrode base material which is not subjected to the bending work (in other words, the portion having not been hardened due to the bending work). More specifically, when the Vickers' hardness (Hv0.5) is equal to or smaller than 210, it is possible to adequately suppress the springback within a practically allowable range and accordingly the discharge gap can be accurately formed. When the Vickers' hardness (Hv0.5) is equal to or smaller than 190, the discharge gap can be more accurately formed. Vickers' hardness data used in this specification are the ones measured according to a micro Vickers' hardness testing method regulated in JIS:Z2244 under a testing force of 4.903N (Hv0.5).

Accordingly, it is preferable that a portion of the electrode base material has not been subjected to work hardening and has a hardness (Hv0.5) equal to or less than 210. This is effective to provide a spark plug which has an electrode base material excellent in workability. Furthermore, it is preferable that a portion of the electrode base material has not been subjected to work hardening and has a hardness (Hv0.5) equal to or less than 190. This is effective to provide a spark plug which has an electrode base material more excellent in workability.

Furthermore, the present invention provides a second spark plug comprising a center electrode, an insulator for holding the center electrode, a housing for fixedly holding the insulator, a ground electrode having a proximal portion fixed to the housing and a distal portion opposing the center electrode, and a noble metallic tip fixed to an electrode base material serving as at least one of the center electrode and the ground electrode, wherein the electrode base material contains NCF600 as a chief component and Al as an additive component.

NCF600 is a Ni-base alloy recognized in JIS (i.e., Japanese Industrial Standard), which comprises 72% Ni, 14–17% Cr, 6–10% Fe, 1% Mn, 0.50% Si, 0.50% Cu, 0.15% C, 0.030% P, 0.015% S. According to the electrode base material of this invention, a chief element is Ni contained in NCF600. Meanwhile, Cr contained in NCF600 serves as an additive element. Al added as an additive component serves as an additive element. Accordingly, the second spark plug can bring the same effects as those of the first spark plug.

Furthermore, it is preferable for the second spark plug of the present invention that an additive amount of Al is in a range from 1.5 to 5.5 weight % (more preferably, in a range from 2.2 to 5.0 weight %).

Furthermore, it is preferable for the second spark plug of the present invention, that a portion of the electrode base material has not been subjected to work hardening and has a hardness (Hv0.5) equal to or less than 210. Furthermore, it is more preferable that a portion of the electrode base material has not been subjected to work hardening and has a hardness (Hv0.5) equal to or less than 190.

Furthermore, the present invention provides a third spark plug comprising a center electrode, an insulator for holding the center electrode, a housing for fixedly holding the insulator, a ground electrode having a proximal portion fixed to the housing and a distal portion opposing the center electrode, and a noble metallic tip fixed to an electrode base material serving as at least one of the center electrode and the ground electrode, wherein a chromium oxide is formed on a surface of the electrode base material and an aluminum oxide is formed beneath chromium oxide when the electrode base material is exposed to an atmospheric environment where the temperature repetitively changes from 300°C. or less to 1,000°C. or above at least 100 times and the electrode base material is kept at a temperature level equal to or larger than 1,000°C. for a cumulative time equal to or exceeding 1 hour.

According to this arrangement, when the spark plug is used in a 1,000° C. or more higher temperature environment giving severe influence to the bonding strength between the electrode base material and the noble metallic tip, the chromium oxide is steadily formed as the surficial oxide film and the aluminum oxide is steadily formed as the inner oxide layer positioned beneath the surficial oxide film.

In this case, the chromium oxide serving as the surficial oxide film and the aluminum oxide serving as the inner oxide layer are formed gradually during the use of engine. Therefore, like the first spark plug of the present invention, there will be no problem in the initial working or machining condition for the electrode base material. Furthermore, there is no necessity of changing the composition of noble metallic tip. This makes it possible to adequately maintain the antiexhaustion properties of the noble metallic tip.

Accordingly, the present invention provides a spark plug capable of assuring satisfactory anti-exhaustion properties of the noble metallic tip as well as satisfactory workability of the electrode base material, and also capable assuring an excellent bonding strength between the noble metallic tip and the electrode base material.

In this case, it is preferable that the chromium oxide and the aluminum oxide of the electrode base material are formed in an outer peripheral region of the noble metallic tip. This enhances the effect of the present invention.

Furthermore, for the first to third spark plugs of the present invention, it is preferable that the noble metallic tip is made of a platinum alloy including Pt as a chief component and at least one additive component selected from the group consisting of iridium (Ir), nickel (Ni), rhodium (Rh), tungsten (W), palladium (Pd), ruthenium (Ru) and osmium (Os).

More specifically, a preferable material for the noble metallic tip is a platinum alloy containing Pt as a chief component and at least one additive component selected from the group consisting of Ir (50 weight % or less), Ni (40 weight % or less), Rh (50 weight % or less), W (30 weight % or less), Pd (40 weight % or less), Ru (30 weight % or less), and Os (20 weight % or less).

Alternatively, it is desirable that the noble metallic tip is made of an iridium alloy including Ir as a chief component and at least one additive component selected from the group consisting of rhodium (Rh), platinum (Pt), nickel (Ni), tungsten (W), palladium (Pd), ruthenium (Ru) and osmium (Os).

More specifically, a preferable material for the noble metallic tip is an iridium alloy containing Ir as a chief component and at least one additive component selected from the group consisting of Rh (50 weight % or less), Pt (50 weight % or less), Ni (40 weight % or less), W (30 weight % or less), Pd (40 weight % or less), Ru (30 weight % or less), and Os (20 weight % or less).

Using the above-described noble metallic tip makes it possible to provide a tip having excellent anti-exhaustion properties. This assures a sufficient life for a spark plug used in a future engine which will be subjected to a severe thermal load.

Furthermore, the present invention provides a method for manufacturing the above-described first to third spark plugs of the present invention, comprising a step of cutting the electrode base material into a final shape of at least one of the center electrode and the ground electrode having a predetermined length and a step of fixing the noble metallic tip to the electrode base material.

According to a conventional method, an electrode base material for the ground electrode is cut into a semifinished shape having a length longer than a final length of the ground electrode. A noble metallic tip is fixed to a predetermined portion of the semifinished ground electrode. And then, the electrode base material is further cut into a final shape of the ground (or center) electrode having a predetermined length. Such a complicated method is necessary due to inherent properties of the conventional base material which causes sag or burr when subjected to a cutting work. Considering the sag or burr to be generated during a cutting work, it is definitely necessary to separate the cutting operation into two stages. Namely, in the first stage, the electrode base material is cut into a relatively long shape so as to leave a margin for the sag or burr. Then, in the second stage succeeding the fixing operation of the noble metallic tip to the electrode base material, the electrode base material is just cut into the final shape of the ground electrode.

In this respect, when the electrode base material of the present invention is used for the ground (or center) electrode, the ground (or center) electrode has an excellent hardness compared with the conventional electrode base material. Thus, it becomes possible to suppress the generation of sag or burr during a cutting work.

Hence, according to the manufacturing method of the present invention, the electrode base material can be just cut into a final shape of the ground (or center) electrode through only one cutting operation. Even when the noble metallic tip is fixed to a portion closer to the cut portion, it is possible to assure a sufficient bonding strength between the noble metallic tip and the electrode base material. Furthermore, there is no necessity of separating the cutting work into two stages. This is effective to reduce the number of required steps in the manufacturing of a spark plug and also to save the material costs.

For example, the present invention provides a manufacturing method for a spark plug comprising a center electrode, an insulator for holding the center electrode, a housing for fixedly holding the insulator, a ground electrode having a proximal portion fixed to the housing and a distal portion opposing the center electrode, and a noble metallic tip fixed to an electrode base material serving as the ground electrode, wherein the electrode base material is an alloy containing a chief element selected from the group consisting of Ni, Fe, and Co and a plurality of additive elements, and at least two kinds of additive elements contained in this alloy have a standard free energy of formation smaller than that of the chief element, the manufacturing method comprising a step of cutting the electrode base material into a final shape of the ground electrode having a predetermined length, and a step of fixing the noble metallic tip to the electrode base material.

BRIEF DESCRIPTION OF THE DRAWINGS

The above and other objects, features and advantages of the present invention will become more apparent from the following detailed description which is to be read in conjunction with the accompanying drawings, in which:

FIG. 4 is a map showing various compositions of tested electrode base materials;

FIG. 5, succeeding FIG. 4, is a map showing the remainder of various compositions of tested electrode base materials;

DESCRIPTION OF THE PREFERRED EMBODIMENTS

Figure 1:
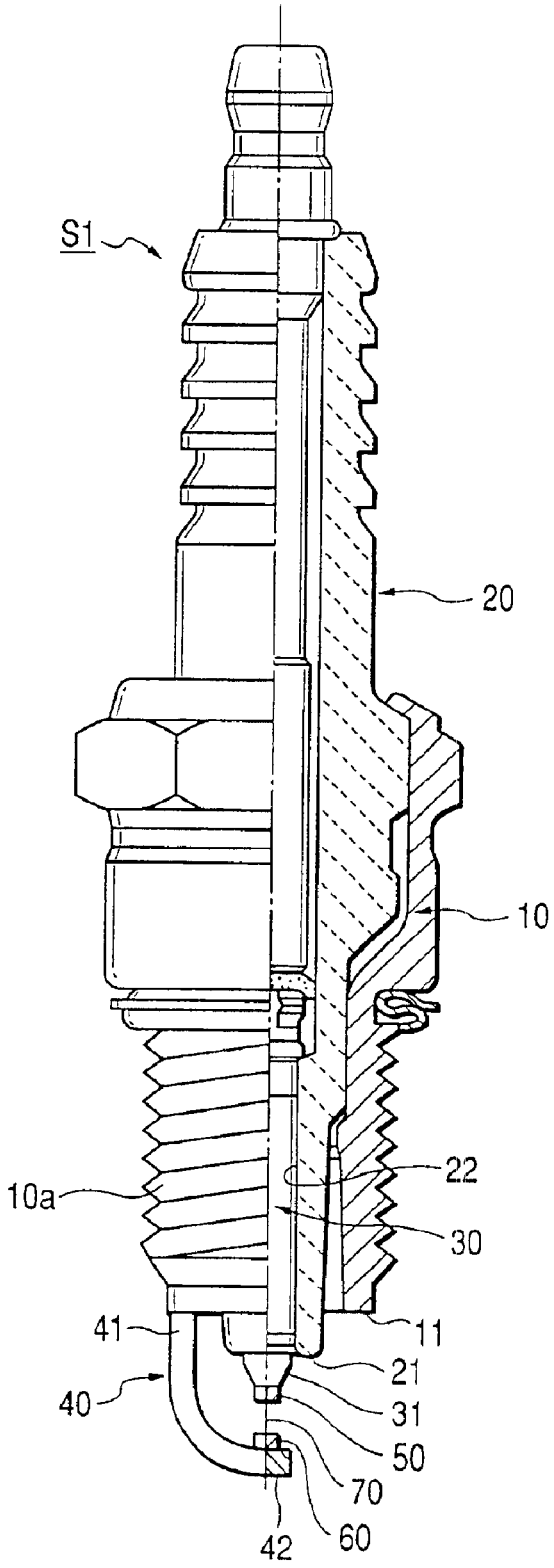
FIG. 1 is a half cross-sectional view showing an overall arrangement of a spark plug in accordance with a preferred embodiment of the present invention.

Preferred embodiments of the present invention will be explained hereinafter with reference to attached drawings. Identical parts are denoted by the same reference numerals throughout the drawings.

Figure 2:
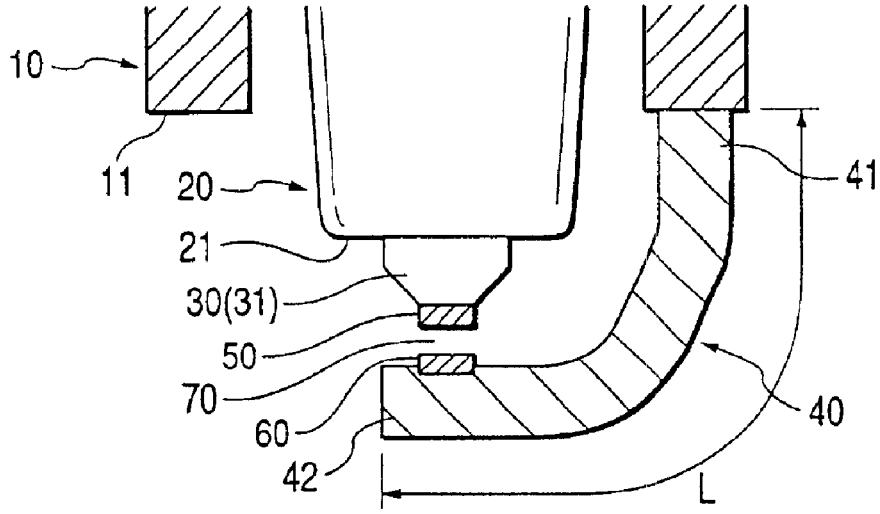
FIG. 2 is a view showing a spark discharge portion and its vicinity of the spark plug shown in FIG. 1.

A preferred embodiment of the present invention will be explained hereinafter with reference to the attached drawings. FIG. 1 is a half crosssectional view showing an overall arrangement of a spark plug S1 in accordance with a preferable embodiment of the present invention. FIG. 2 is an enlarged view showing a spark discharge portion of the spark plug S1.

The spark plug S1 is applicable to an ignition device of an automotive engine and is fixedly inserted into a screw hole opened in an engine head (not shown) defining a combustion chamber of the engine.

The spark plug S1 has a cylindrical metallic housing 10 which is made of an electrically conductive steel member (e.g., low carbon steel). The metallic housing 10 has a threaded portion 10*a* for securely fixing the spark plug S1 to an engine block (not shown). The metallic housing 10 has an inside space for fixedly holding an insulator 20 made of an alumina ceramic ($Al_2O_3$) or the like. One end 21 of insulator 20 is exposed out of one end 11 of the metallic housing 10.

The insulator 20 has an axial hole 22 for fixedly holding a center electrode 30. Thus, the center electrode 30 is held by the metallic housing 10 via the insulator 20. The center electrode 30 has a cylindrical body consisting of an inner member, such as a copper (Cu) or comparable metallic member, having excellent thermal conductivity and an outer member, such as a Ni-base alloy, a Fe-base alloy, a Co-base alloy or a comparable metallic member, having excellent heat resistance and corrosion resistance. As shown in FIG. 2, the center electrode 30 has one end 31 tapered and exposed out of the one end 21 of insulator 20.

A ground electrode 40, made of a Ni-base alloy, or a Fe-base alloy, or a Co-base alloy and configured into a columnar shape (e.g., a square rod), has a proximal portion 41 securely fixed to one end 11 of metallic housing 10 by welding. The ground electrode 40 is bent at an intermediate portion. A distal portion 42 of ground electrode 40 extends toward center electrode 30 so as to oppose one end 31 of center electrode 30.

Each of the center electrode 30 and the ground electrode 40 serves as electrode base material. A noble metallic tip (i.e., center electrode tip) 50, made of Pt, Ir, or a comparable noble metal, is fixed to one end 31 of center electrode 30 by resistance welding. Another noble metallic tip (i.e., ground electrode tip) 60, made of Pt, Ir, or a comparable noble metal, is fixed to distal portion 42 of ground electrode 40 by resistance welding.

As described above, the center electrode 30 and the ground electrode 40 is made of an electrode base material such as a Ni-base alloy, or a Fe-base alloy, or a Co-base alloy. According to this embodiment, the alloy constituting the electrode base material contains at least two kinds of additive elements in addition to a chief element (i.e., an element in the electrode base material having the greatest quantity) selected from the group consisting of Ni, Fe, and Co.

In this case, at least two kinds of additive elements (e.g., Cr, Al, Si) have a standard free energy of formation for oxidation smaller than that of the chief element (Ni, Fe, Co).

According to this embodiment, the electrode base material for the center electrode 30 and the ground electrode 40 is a Ni-base alloy containing Ni as a chief element as well as Cr, Al and Si as additive elements. Additionally, to improve the forging properties, the electrode base material includes Fe. Moreover, to improve the deoxidizing properties during the manufacturing process, the electrode base material contains Mn.

For example, NCF600 recognized according to JIS (i.e., Japanese Industrial Standard) is a practical Ni-base alloy. The electrode base material containing NCF600 and additives, such as Al, can be used for the center electrode 30 and the ground electrode 40.

Furthermore, a practical material for the center electrode tip 50 and the ground electrode tip 60 is a platinum alloy including Pt as a chief component and at least one additive component selected from the group consisting of Ir, Ni, Rh, W, Pd, Ru and Os. Alternatively, the practical material for the center electrode tip 50 and the ground electrode tip 60 is an iridium alloy including Ir as a chief component and at least one additive component selected from the group consisting of Rh, Pt, Ni, W, Pd, Ru and Os.

More specifically, the platinum alloy contains Pt as a chief component and at least one additive component selected from the group consisting of Ir (50 weight % or less), Ni (40 weight % or less), Rh (50 weight % or less), W (30 weight % or less), Pd (40 weight % or less), Ru (30 weight % or less), and Os (20 weight % or less).

When the noble metallic tip (50, 60) is made of an iridium alloy, it is preferable that the iridium alloy contains Ir as a chief component and at least one additive component selected from the group consisting of Rh (50 weight % or less), Pt (50 weight % or less), Ni (40 weight % or less), W (30 weight % or less), Pd (40 weight % or less), Ru (30 weight % or less), and Os (20 weight % or less).

Adopting such materials for the tips 50 and 60 makes it possible to provide a noble metallic tip having excellent anti-exhaustion properties. This assures a sufficient life for a spark plug used in a future engine which will be subjected to a severe thermal load.

According to the spark plug S1, a spark discharge occurs in a discharge gap 70 formed between these noble metallic tips 50 and 60 to ignite the gas mixture in the combustion chamber. The ignition by the spark plug S1 causes a flame kernel in the discharge gap 70 which grows throughout the combustion chamber so as to accomplish the combustion of the gas mixture charged into the combustion chamber.

According to this embodiment, the noble metallic tips 50 and 60 are fixed to the electrode base materials 30 and 40 which are made of an alloy containing a chief element selected from the group of Ni, Fe and Co and at least two kinds of additive elements. These additive elements have a standard free energy of formation (i.e., standard free energy of formation for oxidation) smaller than that of the chief element.

Figure 3:
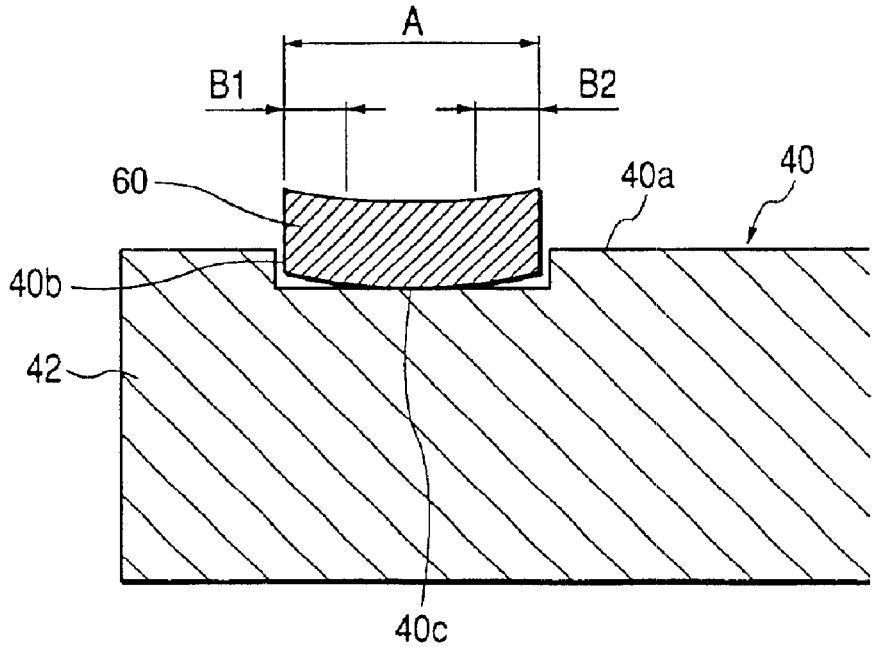
FIG. 3 is an enlarged cross-sectional view showing a bonding portion between a ground electrode and a ground electrode tip of the spark plug shown in FIG. 1.

Using the electrode base material having the above-described arrangement makes it possible to greatly improve the bonding strength between the electrode base materials 30 and 40 and the noble metallic tips 50 and 60. FIG. 3 shows a cross-sectional view schematically showing a joint arrangement between the ground electrode (i.e., electrode base material) 40 and the ground electrode tip 60. The effect of improving the bonding strength will be explained hereinafter with reference to FIG. 3. However, the same explanation can be applied to a joint arrangement between the center electrode (i.e., electrode base material) 30 and the center electrode tip 50.

In a high-temperature engine operating condition, the additive element having a relatively smaller standard free energy of formation tends to oxidize easily compared with the chief element having a relatively larger standard free energy of formation. Thus, the additive element having a relatively smaller standard free energy of formation moves toward a surface 40*a* of the ground electrode 40 and forms an oxide.

Adding at least two kinds of additive elements having a standard free energy of formation smaller than that of the chief element makes it possible to form a double-layer arrangement due to the difference of oxidation tendency of each additive element. At least one additive element steadily forms a surficial oxide film on the surface 40*a* of the ground electrode 40. At least one other additive element forms an inner oxide layer beneath the surficial oxide film.

Accordingly, the surficial oxide film is steadily formed on the surface 40*a* of the ground electrode 40. Hence, it becomes possible to suppress the oxidative reaction advancing toward the inside of the electrode base material. Thus, it becomes possible to assure the heat and oxidation resistance properties which are required as fundamental properties of the electrode base material.

Furthermore, in the ground electrode 40, the inner oxide layer steadily resides in the vicinity of an outer peripheral region 40*b* of the noble metallic tip 60 which becomes a trigger point of oxidative reaction. The inner oxide layer steadily residing in the outer peripheral region 40*b* of the noble metallic tip 60 makes it possible to decrease the thermal expansion coefficient difference between the ground electrode 40 and the noble metallic tip 60 in this region. Thus, it becomes possible to reduce a thermal stress appearing in the outer peripheral region 40*b* of the noble metallic tip 60 which becomes a trigger point of oxidative reaction. This greatly increases the bonding strength between the electrode base material and the noble metallic tip.

If the electrode base material includes only one kind of additive element, only the surficial oxide layer will be formed on the surface of the electrode base material. Along a joint surface 40*c* between the ground electrode (i.e., electrode base material) 40 and the noble metallic tip 60, the oxidative reaction possibly advances from the outer peripheral region of the tip. The bonding strength will decrease. Alternatively, there is a possibility that only the inner oxide layer is formed inside the ground electrode 40. In this case, the oxidative reaction advances toward the inside of ground electrode 40. The electrode base material may not be able to secure sufficient heat and oxidation resistance properties.

Furthermore, formation of the surficial oxide film and the inner oxide layer gradually advances in accordance with the use of engine. Therefore, if an additive amount of each additive element is adequately adjusted, there will be no problem in the initial working or machining condition for the ground electrode (i.e., electrode base material) 40. Furthermore, there is no necessity of changing the composition of noble metallic tip 60. This makes it possible to adequately maintain the anti-exhaustion properties of the noble metallic tip 60.

Accordingly, this embodiment provides a spark plug capable of assuring satisfactory anti-exhaustion properties of the noble metallic tips 50 and 60 as well as satisfactory workability of the electrode base materials 30 and 40, and also capable of assuring an excellent bonding strength between the noble metallic tip and the electrode base material.

Especially, the spark plug S1 may be used in a severe high-temperature condition (e.g., a temperature range of 1,000° C. to 1,100° C.). Even in such a severe condition, the effects of this embodiment can be surely obtained always when the electrode base material satisfies the above-described relationship with respect to the standard free energy of formation.

More specifically, according to this embodiment, the elements of the electrode base material satisfy the following relationships, $$E1<1.2\times E0 \text{ and } E2<1.2\times E1$$

wherein E0 represents a standard free energy of formation of the chief element at a temperature range from 1,000° C. to 1,100° C., E1 represents a standard free energy of formation of one kind of additive element at the temperature range from 1,000° C. to 1,100° C., and E2 represents a standard free energy of formation of at least one other additive element at the temperature range from 1,000° C. to 1,100° C.

According to this arrangement, when a spark plug is used in a high-temperature range from 1,000° C. to 1,100° C., the additive element having a relatively larger standard free energy of formation E1 forms a rigid surficial oxide film, while the additive element having a relatively smaller standard free energy of formation E2 forms an inner oxide layer.

As described above, according to this embodiment, the electrode base materials 30 and 40 contains NCF600 with additives of Al or the like. Namely, the electrode base materials 30 and 40 are made of a Ni-base alloy containing Ni as a chief element and Cr, Al, and Si as additive elements. Additionally, to improve the forging and deoxidizing properties, this Ni-base alloy further contains Fe and Mn. The following is the reason why such a Ni-base alloy is adopted.

First, Ni is adopted as a chief element because the electrode base materials 30 and 40 can be constituted by a Ni-base alloy which has excellent properties in high-temperature strength as well as in heat and oxidation resistance properties.

Furthermore, the Ni-base alloy (i.e., electrode base material) includes Ni as a chief element. The standard free energy of formation E0 of Ni is −60 kcal at 1,000° C. Meanwhile, the standard free energy of formation E1 of Cr is −120 kcal. The standard free energy of formation E2 of Al is −200 kcal. These data satisfy the above-described relationship E1<1.2E0 and E2<1.2E1 with respect to the standard free energy of formation.

In a high-temperature environment during an engine operation, Cr having a relatively larger standard free energy of formation E1 oxidizes and forms the surficial oxide film, while Al having a relatively smaller standard free energy of formation E2 oxidizes and forms the inner oxide layer.

Furthermore, the inventors have experimentally confirmed that, among a plurality of additive elements, an additive element having the greatest quantity forms the surficial oxide film. According to the two-component series state graph, Cr has the largest solid solubility among the additive elements contained in Ni. Hence, selecting Cr as the additive element having the greatest quantity makes sure that Cr forms the rigid surficial oxide film and Al (i.e., an additive element other than Cr) forms the inner oxide layer.

Furthermore, using Al as an additive element other than Cr is effective to improve the joint or bond strength because an aluminum oxide serving as the inner oxide layer deposits in the electrode base materials 30 and 40 and forms a composite layer consisting of the electrode base material and the aluminum oxide.

The aluminum oxide has a relatively small thermal expansion coefficient. An overall thermal expansion coefficient of this composite layer becomes closer to the thermal expansion coefficient of the noble metallic tips 50 and 60. Accordingly, it becomes possible to relax a thermal stress acting on the boundary of the electrode base material and an outer peripheral region of the noble metallic tip. Thus, the bonding or joint strength between the electrode base material and the noble metallic tip can be improved.

Test for Demonstrating the Properties of Electrode Base Materials

The inventors have conducted several tests to check the workability and the oxidation resistance of electrode base materials (ground electrode 40 in this embodiment) and also check the bonding strength between the electrode base materials and the noble metallic tips 50 and 60. Various electrode base materials having mutually different compositions are used in these tests.

The tested electrode base materials are Ni-base alloys comprising Cr, Al, Fe, Si, Mn, and the remainder (Ni+unavoidable impurities). The unavoidable impurities include Ti (0.5 weight % or less), C (0.06 weight % or less), S (0.05 weight % or less), Cu (0.1 weight % or less), and Mo (0.1 weight % or less)).

FIGS. 4 and 5 show the compositions of tested samples No. 1 to No. 21 of the electrode base materials. Only the tested samples having acceptable workability (indicated by ○) are subsequently subjected to engine tests to check the heat and oxidation resistance properties as well as the bonding strength or bondability. Samples No. 19 and No. 21, having bad workability (indicated by ×), are too hard to prevent the generation of cracks during a wire drawing operation. For the purpose of comparison, FIG. 5 shows test data of a conventional electrode base material.

To perform the engine tests for the samples having acceptable workability, a columnar ground electrode tip 60, having a diameter of 1 mm and made of Pt—20Ir—2Ni, is fixed each tested sample (i.e., ground electrode 40) by resistance welding.

The following is the conditions for the resistance welding.

Pressure is 30 kg. Cycle number is 10. Current is adjustable in the range of 1.1~1.5 kA according to the composition of each tested sample.

The engine tests were conducted on a 2,000 cc engine to thoroughly perform 3,000 cycles of the temperature cycle test consisting of 1-minute fully throttle opened operation at the engine speed of 6,000 rpm and 1-minute idling operation.

This test condition is equivalent to 100,000 km traveling by a practical engine. After finishing the engine tests, the heat and oxidation resistance properties of each tested sample was checked. And also, the bonding strength between the electrode base material 40 and the tip 60 of each tested sample was checked.

Regarding the heat and oxidation resistance properties (i.e., oxidation resistivity), each tested sample indicated by ○ has a satisfactory surficial oxide film (i.e., chromium oxide) steadily formed on the ground electrode 40 and no oxidation advancing inside the electrode base material. Each tested sample indicated by × has an insufficient surficial oxide film and some oxidation advancing inside the electrode base material.

Regarding the bonding strength between the electrode base material 40 and the tip 60 (i.e., tip bondability), each tested sample indicated by ○ has a peel ratio equal to or less than 25% while each tested sample indicated by × has a peel ratio larger than 25%. The peel ratio is defined by (B1+B2)/A %, where 'A' represents an initial length of a joint surface between the electrode base material 40 and the noble metallic tip 60, 'B1+B2' represents a total peel length found after the engine test, as shown in FIG. 3.

FIGS. 4 and 5 show the evaluation result of all of the workability, the oxidation resistivity, and the tip bondability. From the evaluation result shown in FIGS. 4 and 5, it is understood that every test sample containing Cr by an amount of 10 weight % or more can attain acceptable oxidation resistivity which is essentially required for the electrode base material. When the content of Cr is less than 10 weight %, the surficial oxide film is not steadily formed on the electrode base material. Furthermore, considering the workability, it is believed that the upper limit of Cr is 20 weight %.

Furthermore, it is understood that the tip bondability is dissatisfactory when the additive amount of Cr is less than three times the additive amount of Al. In this case, it is believed that the aluminum oxide forms the surficial oxide film rather than the chromium oxide. On the other hand, the chromium oxide forms the inner oxide layer.

When the additive amount of Cr is at least three times the additive amount of Al, the chromium oxide film is steadily formed and serves as the surficial oxide layer. The aluminum oxide layer having a relatively smaller thermal expansion coefficient deposits inside the electrode base material and serves as the inner oxide layer. The thermal stress is relaxed and the bondability is improved. The sample No. 11 forms an inner oxide layer of Si, although the bondability is not improved.

Figure 6:
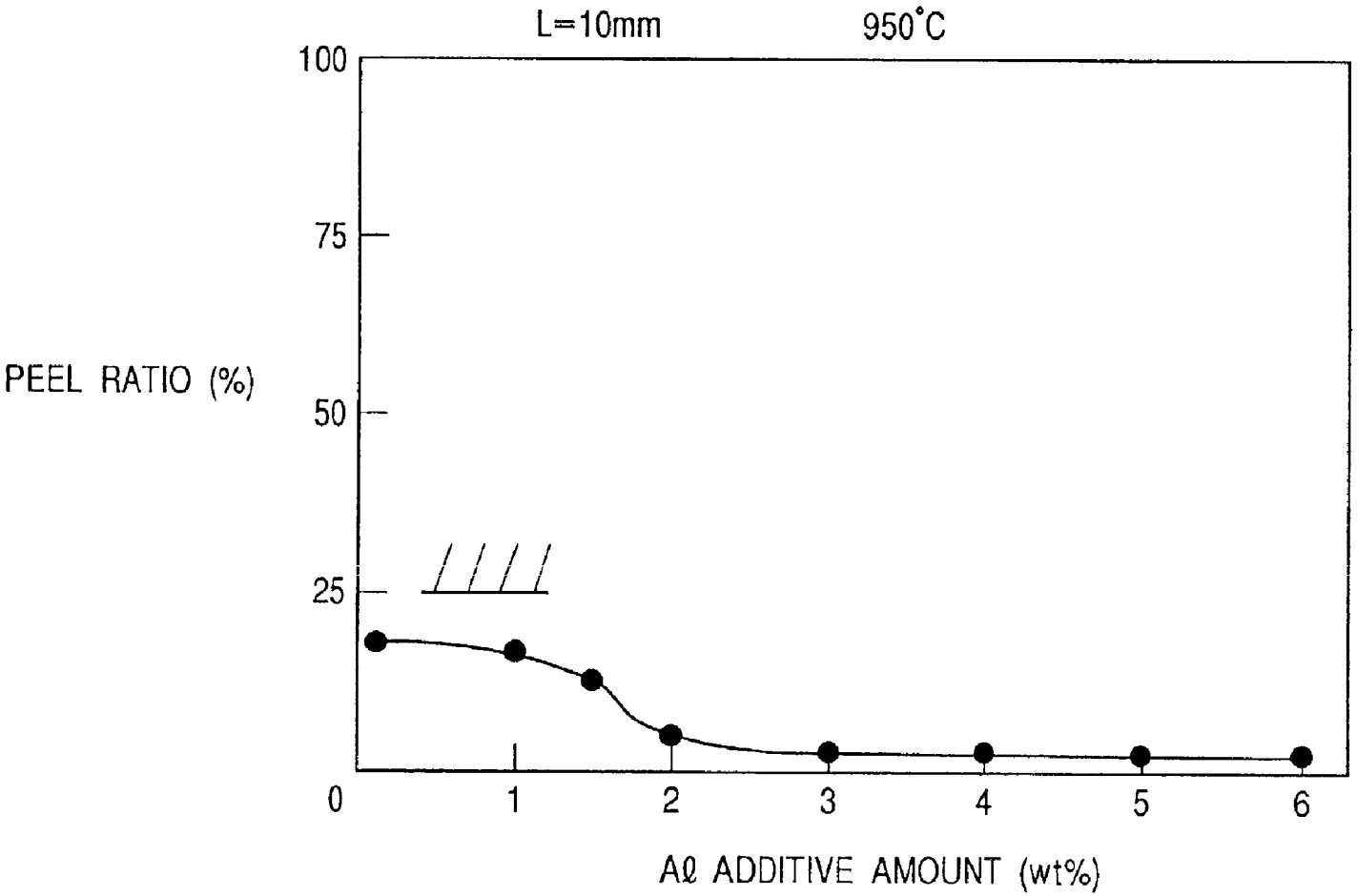
FIG. 6 is a graph showing a relationship between peel ratio and Al additive amount in a case where the electrode base material contains Cr and Al as additive elements and an additive amount of Cr is fixed to 16 weight %.
Figure 7:
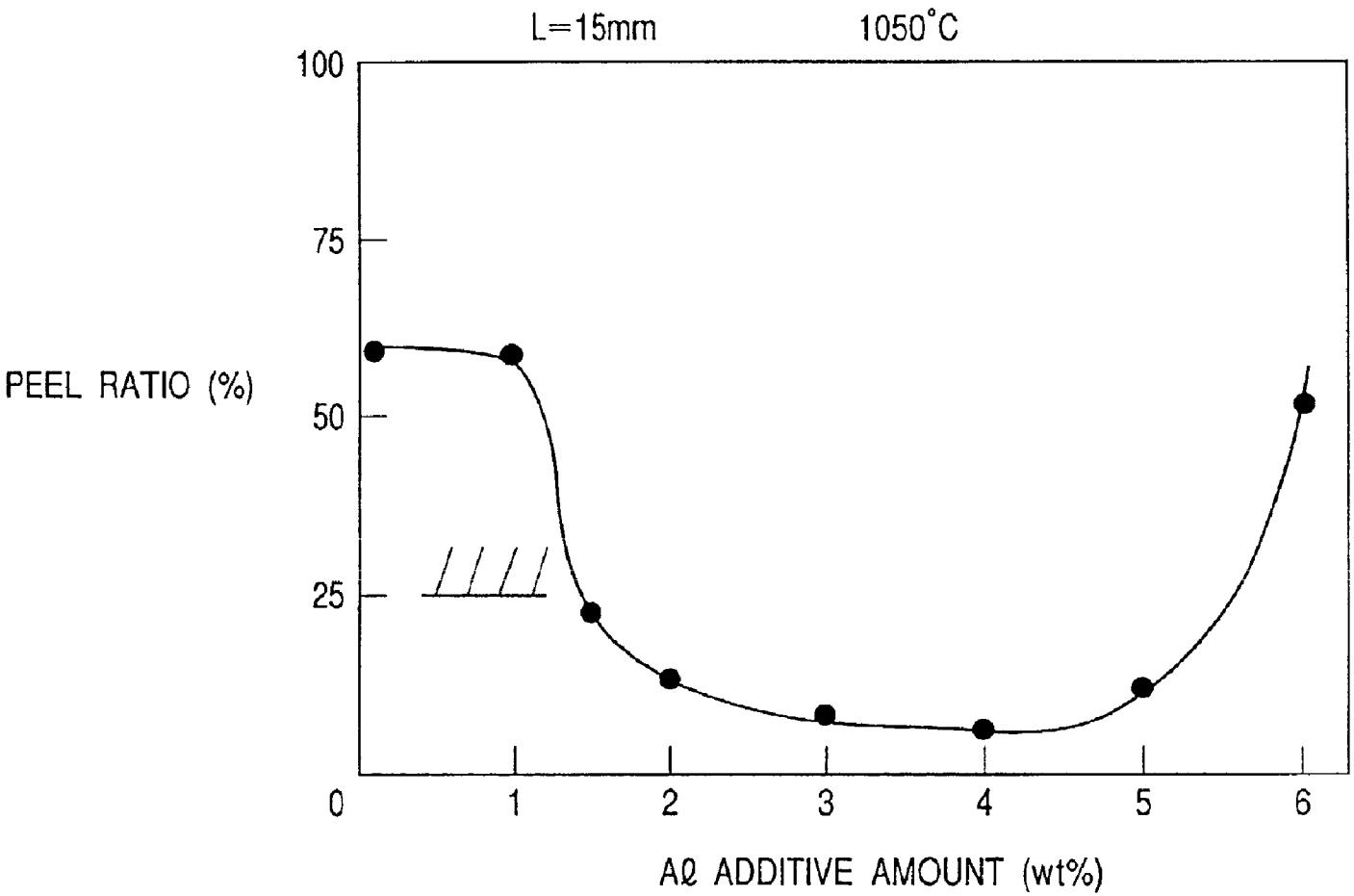
FIG. 7 is a graph showing a relationship between peel ratio and Al additive amount in a case where a ground electrode temperature is higher than the case of FIG. 6.

FIGS. 6 and 7 show the test result of tip bodability (i.e., peel ratio) obtained by changing the additive amount of Al while fixing the additive amount of Cr to 16 weight %. FIG. 6 shows test result obtained under conditions that the length L (refer to FIG. 2) of ground electrode 40 is 10 mm and the temperature during the engine test is 950° C. at the distal portion 42 of ground electrode 40 (i.e., distal end temperature=950° C.). FIG. 7 shows test result obtained under conditions that the length L of ground electrode 40 is 15 mm and the distal end temperature is 1,050° C.

According to the development of engine techniques, it is assumed that the electrode temperature of a future engine will be 100° C. higher than that of present-day engine (i.e., the condition of engine test shown in FIG. 6). The engine test condition of FIG. 7 reflects such a trend of future engines. To realize the condition of FIG. 7, a protruding amount of ground electrode 40 was increased and accordingly the length of ground electrode 40 became 5 mm longer than an ordinary value. In this manner, the engine test condition of FIG. 7 was realized by forcibly increasing the electrode temperature to perform the endurance test.

In both cases of FIGS. 6 and 7, the tip bondability can be improved when the additive amount of Al is equal to or larger than 1.5 weight %. In the case of FIG. 7, the tip bondability is rather worsened when the additive amount of Al exceeds 5.5 weight %. This is believed that, when the electrode temperature becomes further higher, the inner aluminum oxide increases excessively and gives adverse influence to the tip bondability. Furthermore, when the additive amount of Al exceeds 5.5 weight %, the workability of the electrode base material is worsened (refer to sample No. 19 shown in FIG. 5).

From the evaluation results shown in FIGS. 4 to 7, it is preferable for the Ni-base alloy of this embodiment that the additive amount of Cr is at least three times the additive amount of Al and in the range from 10 to 20 weight % while the additive amount of Al is in the range from 1.5 to 5.5 weight % (more preferably, in the range from 2.2 to 5.0 weight %).

Furthermore, it is preferable for the electrode base material made of the Ni-base alloy of this embodiment that a total amount of the elements (e.g., Fe, Si, Mn) other than Ni, Cr, and Al is equal to or smaller than 20 weight %.

Adding Fe is effective to improve the forging property of the electrode base material. However, excessively adding Fe worsens the state of Cr and Al oxides. Furthermore, adding Si and Mn is effective to improve the deoxidizing properties of the electrode base material during its manufacturing. However, excessively adding Si and Mn worsens the forging properties of the electrode base material.

It is preferable that the electrode base materials 30 and 40 includes at least one kind of rare earth element by an amount of 1 weight % or less. Adding the rare earth element is effective to improve the oxidation resistance.

Figure 8A:
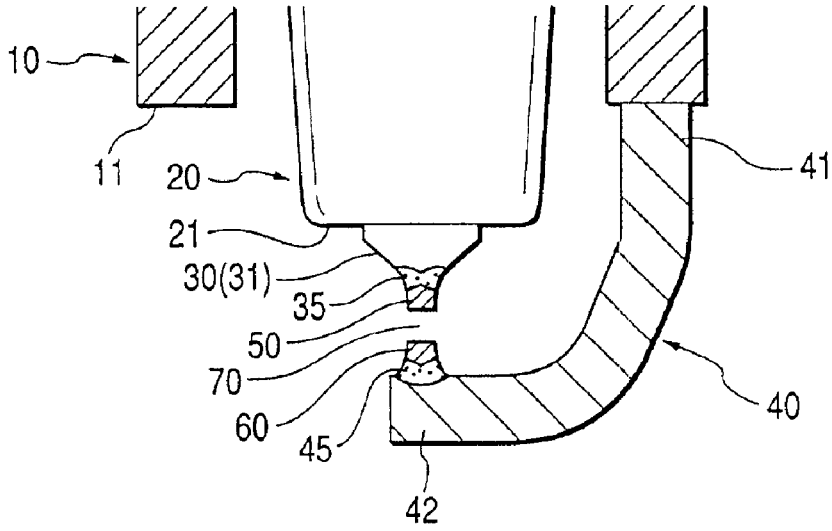
FIG. 8A is a cross-sectional view showing a spark discharge portion and its vicinity in a case where a noble metallic tip is fixed to an electrode base material by laser welding.
Figure 8B:
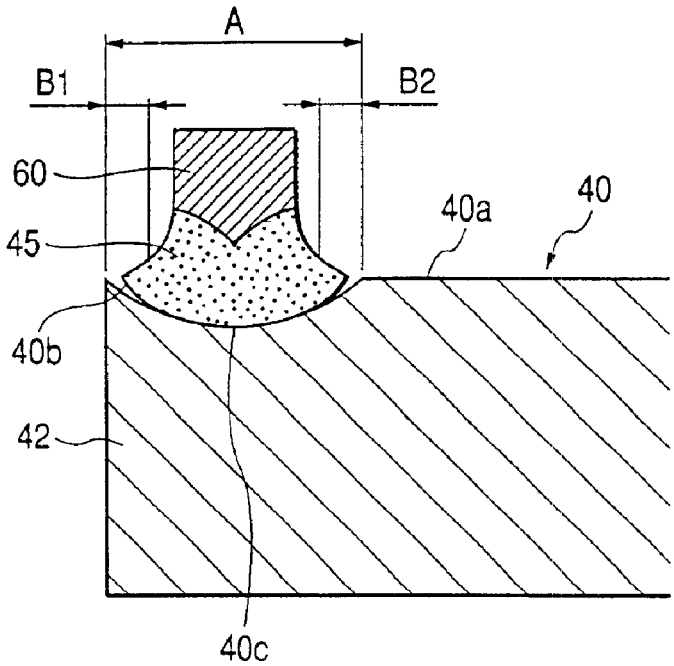
FIG. 8B is an enlarged cross-sectional view showing a bonding portion between a ground electrode and a ground electrode tip in the spark plug shown in FIG. 8A.

Furthermore, as shown in FIG. 8, the noble metallic tips 50 and 60 can be fixed to the electrode base materials 30 and 40 via fused portions 35 and 45 by laser welding. The same effects can be obtained in such an arrangement. Furthermore, instead of using a platinum alloy, it is also preferable to use an iridium alloy for the noble metallic tips 50 and 60.

Method for Fixing Noble Metallic Tip to Electrode Base Material

The spark plug S1 can be manufactured by using a conventional method. However, it is also possible to fix the noble metallic tip 60 to the ground electrode 60 by using a different method. Hereinafter, the method for fixing the noble metallic tip 60 to the ground electrode 40 of this embodiment will be explained.

First, for the purpose of comparison, a conventional method for fixing the noble metallic tip 60 to the ground electrode 40 will be explained with reference to FIG. 9.

Figure 9:
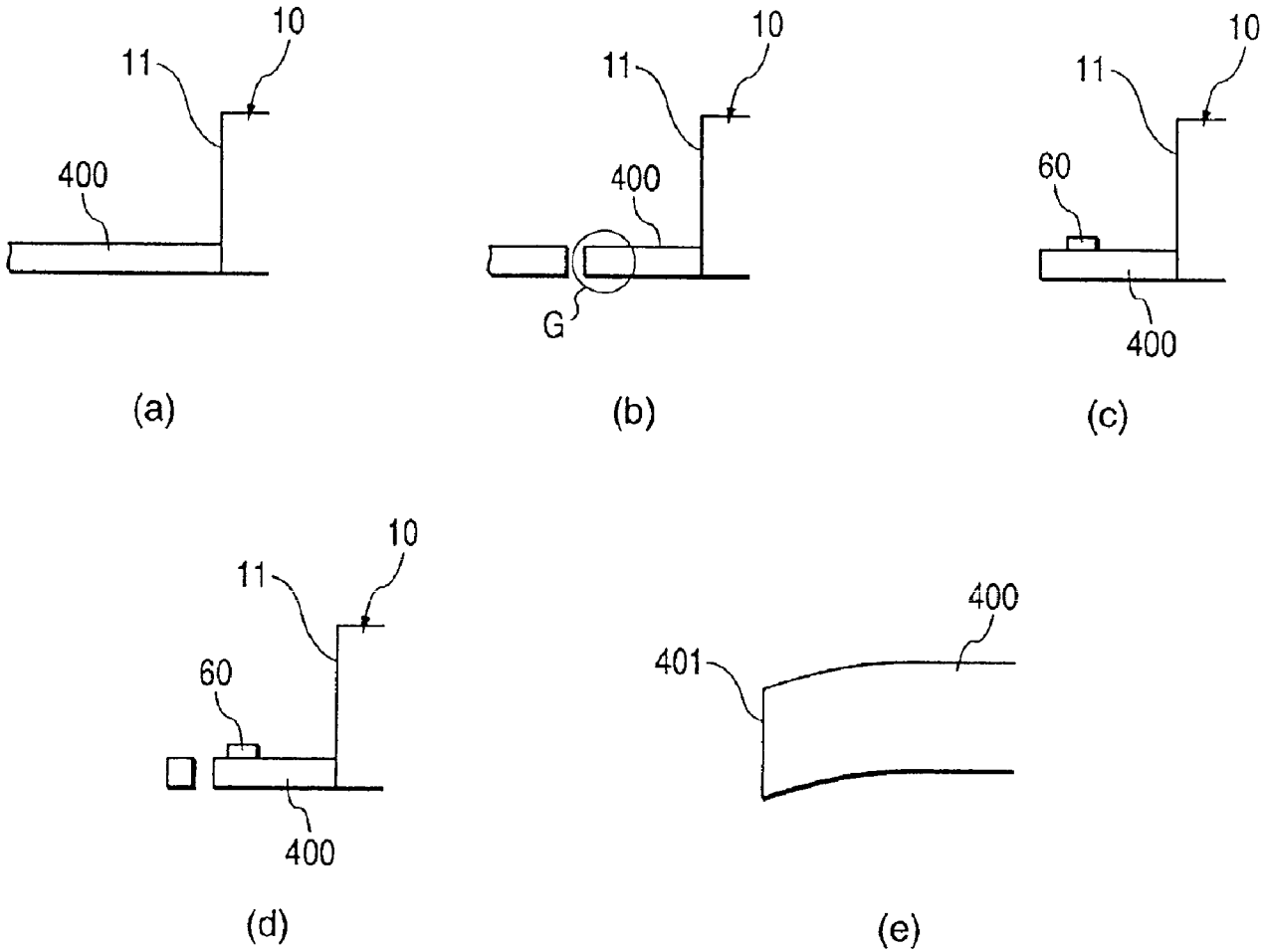
FIG. 9 PRIOR ART
FIGS. 9(*a*) to 9(*e*) are sequential views explaining a conventional method for fixing a noble metallic tip to a ground electrode.

A rodlike electrode base material 400, serving as the ground electrode 40, is welded to one end 11 of metal housing 10 (refer to FIG. 9(*a*)). The electrode base material 400 is cut into a shape having a length longer than a final length of ground electrode 40 (refer to FIG. 9(*b*)). Then, the noble metallic tip 60 is welded to a predetermined portion of the electrode base material 400 (refer to FIG. 9(*c*)). Then, the electrode base material 400 is again cut into the final shape of ground electrode 40 having a predetermined length (refer to FIG. 9(*d*)).

The following is the reason why the conventional manufacturing method is so complicated. FIG. 9(*e*) is an enlarged view showing an encircled portion 'G' shown in FIG. 9(*b*). According to the conventional electrode base material 400 for the ground electrode, as shown in FIG. 9(*e*), the electrode base material 400 causes sag or burr at its cut edge portion 401. If the noble metallic tip 60 is welded to the deformed cut edge portion 401, no satisfactory bondability will be obtained.

Hence, it is necessary to perform a first step of welding the noble metallic tip 60 onto a flat surface of electrode base material 400 to assure a satisfactory bondability and then perform a second step of again cutting the electrode base material 400 into the final shape of ground electrode 40.

On the contrary, the electrode base material of this embodiment contains Cr and Al as additive elements by the above-described amounts. When this electrode base material is used to manufacture the ground electrode 40, no sag or burr is produced because the electrode base material of this embodiment is harder than the conventional electrode base material.

Hence, when the ground electrode 40 is manufactured by the electrode base material of this embodiment, the electrode base material is directly cut into the final shape of ground electrode 40 having a predetermined length. Then, the noble metallic tip 60 is fixed to the electrode base material by resistance welding or laser welding.

According to the manufacturing method of this embodiment, the electrode base material is cut into the final shape of ground electrode 40 without leaving any margin for the sag or burr. Even if the noble metallic tip 60 is fixed to the vicinity of the cut edge portion, excellent bondability can be assured. There is no necessity of separating the cutting work of the electrode base material into two stages. This is advantageous in that not only the number of manufacturing steps can be reduced but also the cost for the marginal materials can be saved.

Figure 10:
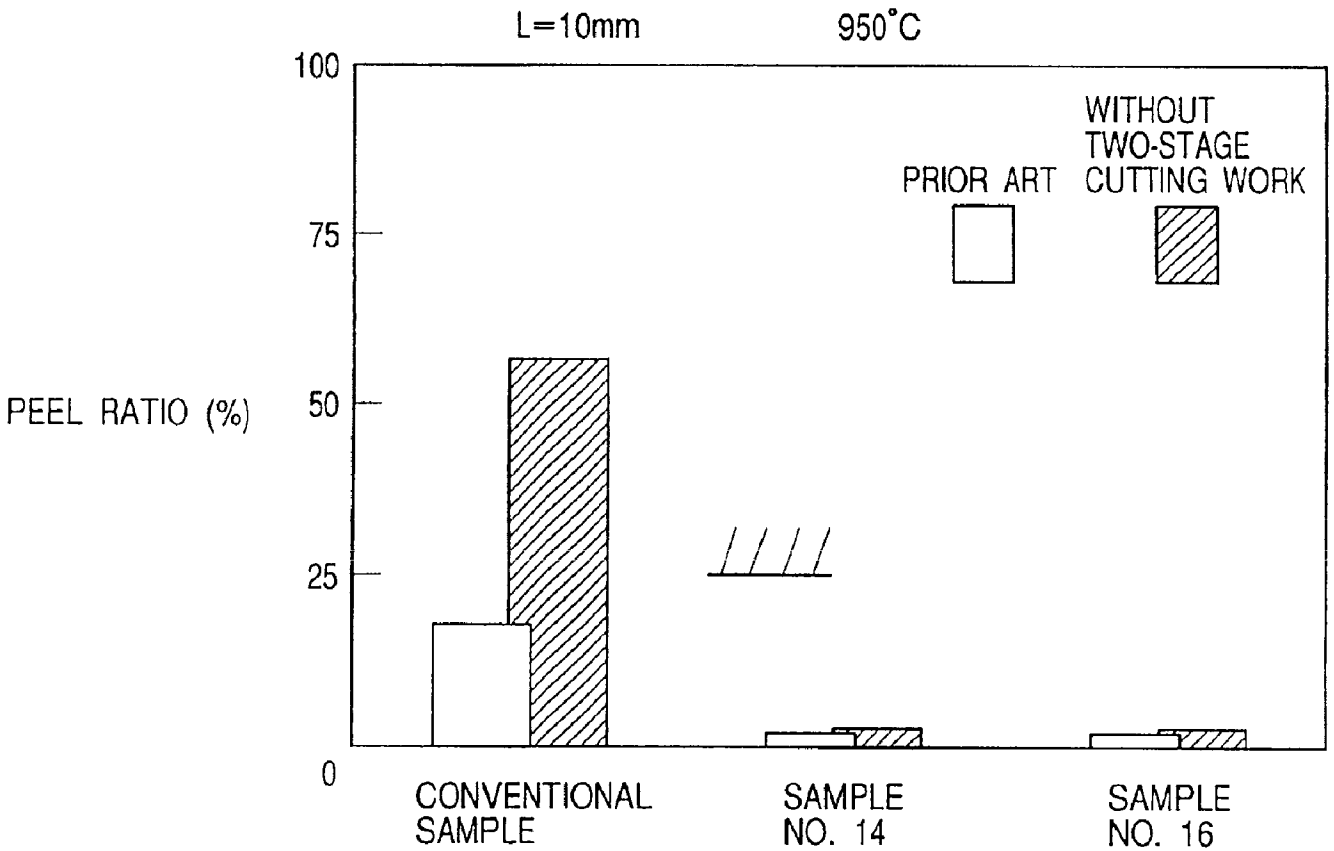
FIG. 10 is a graph showing practical effects brought by a present invention method for fixing the noble metallic tip to the ground electrode.
Figure 11:
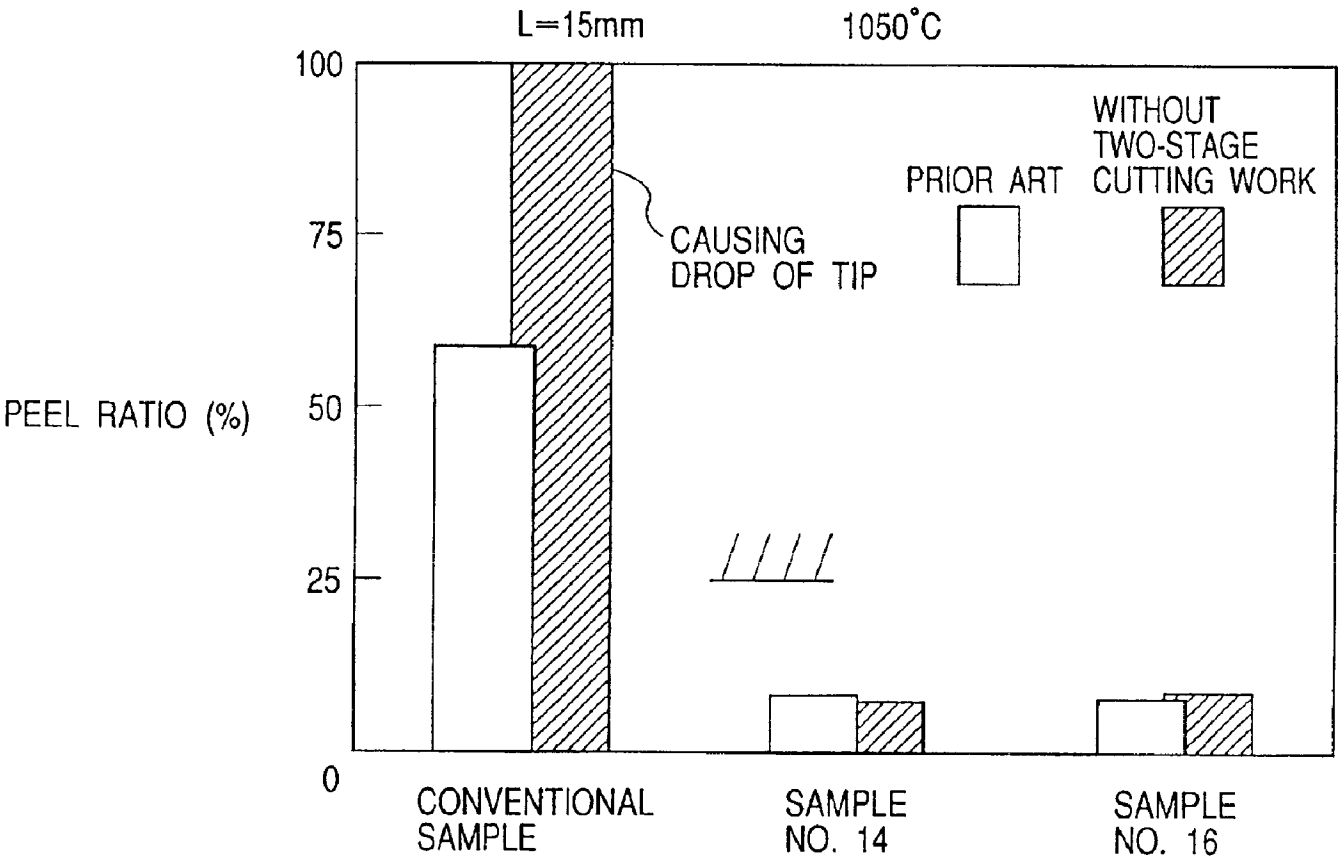
FIG. 11 is a graph showing another practical effects brought by the present invention method for fixing the noble metallic tip to the ground electrode.

FIGS. 10 and 11 show detailed effects of the method for fixing the noble metallic tip to the electrode base material in accordance with this embodiment. The electrode base materials used in this evaluation are the samples No. 14 and No. 16 and the conventional sample shown in FIG. 5. For each sample, the tip bondability of ground electrode tip 60 was checked in both of the conventional method explained with reference to FIG. 9 and the present invention method.

The welding operation of ground electrode tip 60 was performed by using the same resistance welding conditions as those used in the evaluation of FIGS. 4 and 5. The tip bondability was evaluated after finishing the engine test, with the above-described peel ratio used in the evaluation of FIGS. 4 and 5. FIG. 10 shows test result obtained under conditions that the length L (refer to FIG. 2) of ground electrode 40 is 10 mm and the temperature during the engine test is 950° C. at the distal portion 42 of ground electrode 40 (i.e., distal end temperature=950° C.). FIG. 11 shows test result obtained under conditions that the length L of ground electrode 40 is 15 mm and the distal end temperature is 1,050° C.

From the result of FIGS. 10 and 11, it is understood that the present invention method can lower the peel ratio and accordingly improve the tip bondability compared with the conventional method. Regarding the samples No. 14 and No. 16, satisfactory peel ratios can be obtained by using either the conventional method or the present invention method.

Hardness of Electrode Base Material

Furthermore, according to this embodiment, it becomes possible to accurately form the discharge gap when the hardness (Hv0.5) of the electrode base material is equal to or larger than 210. The discharge gas can be more accurately formed when the hardness (Hv0.5) of the electrode base material is equal to or larger than 190. As described above, the hardness of the electrode base material increases with increasing additive amount of Al.

Figure 12:
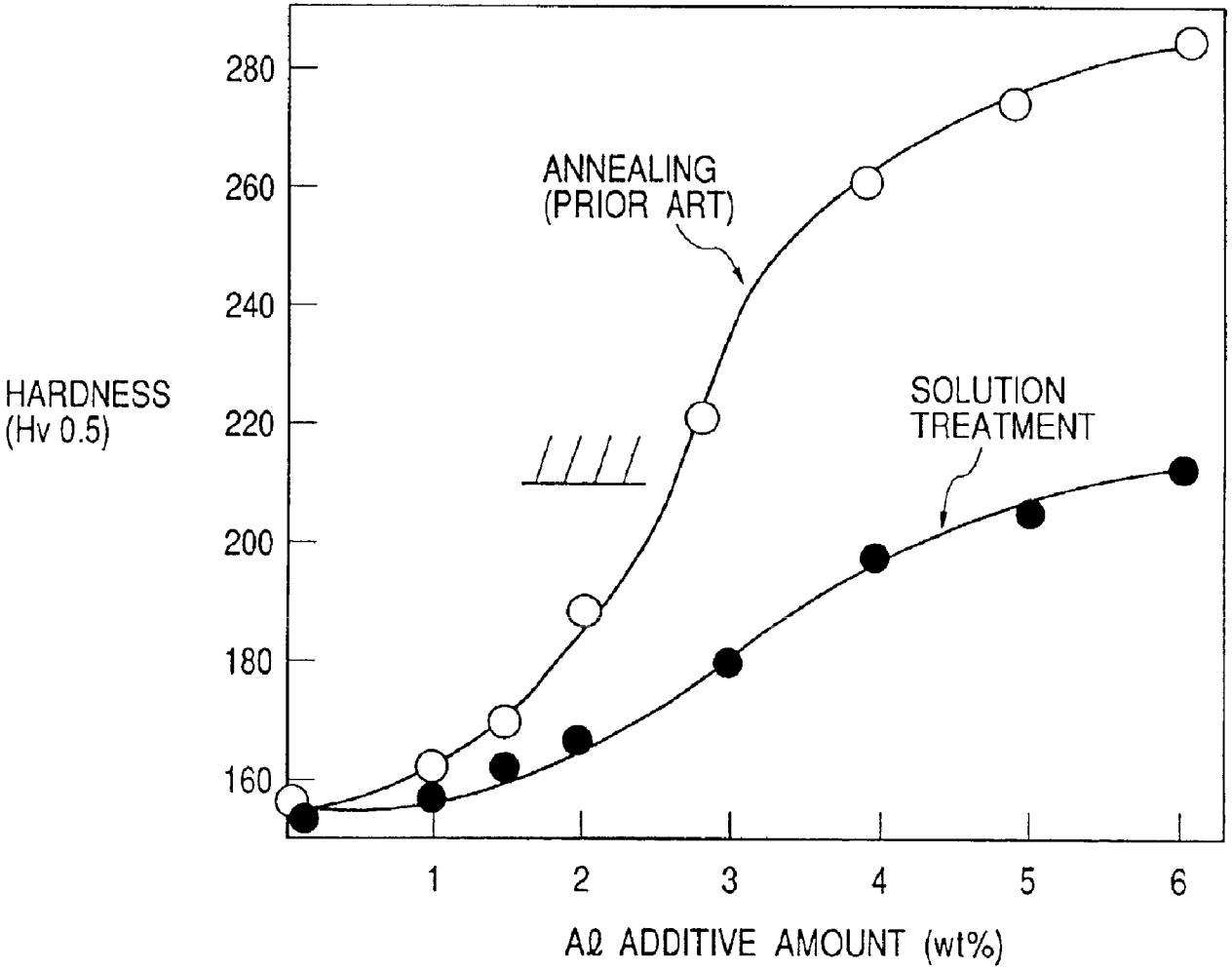
FIG. 12 is a graph showing a relationship between hardness and Al additive amount of the electrode base material.

In this case, it is desirable to perform the solution treatment for lowering the hardness of the electrode base material. This facilitates the bending work for adjusting the discharge gap. FIG. 12 shows evaluation result according to the inventors with respect to the hardness of an electrode base material which contains NCF600 as a chief component and Al as an additive component. In this evaluation, the hardness of the tested electrode base material was measured by variously changing the additive amount of Al. It is confirmed that the electrode base material having been subjected to the solution treatment can realize a lower hardness compared with the one not having been subjected to the solution treatment (i.e., the annealed one in this embodiment) even when the additive amount of Al is increased.

Figure 13:
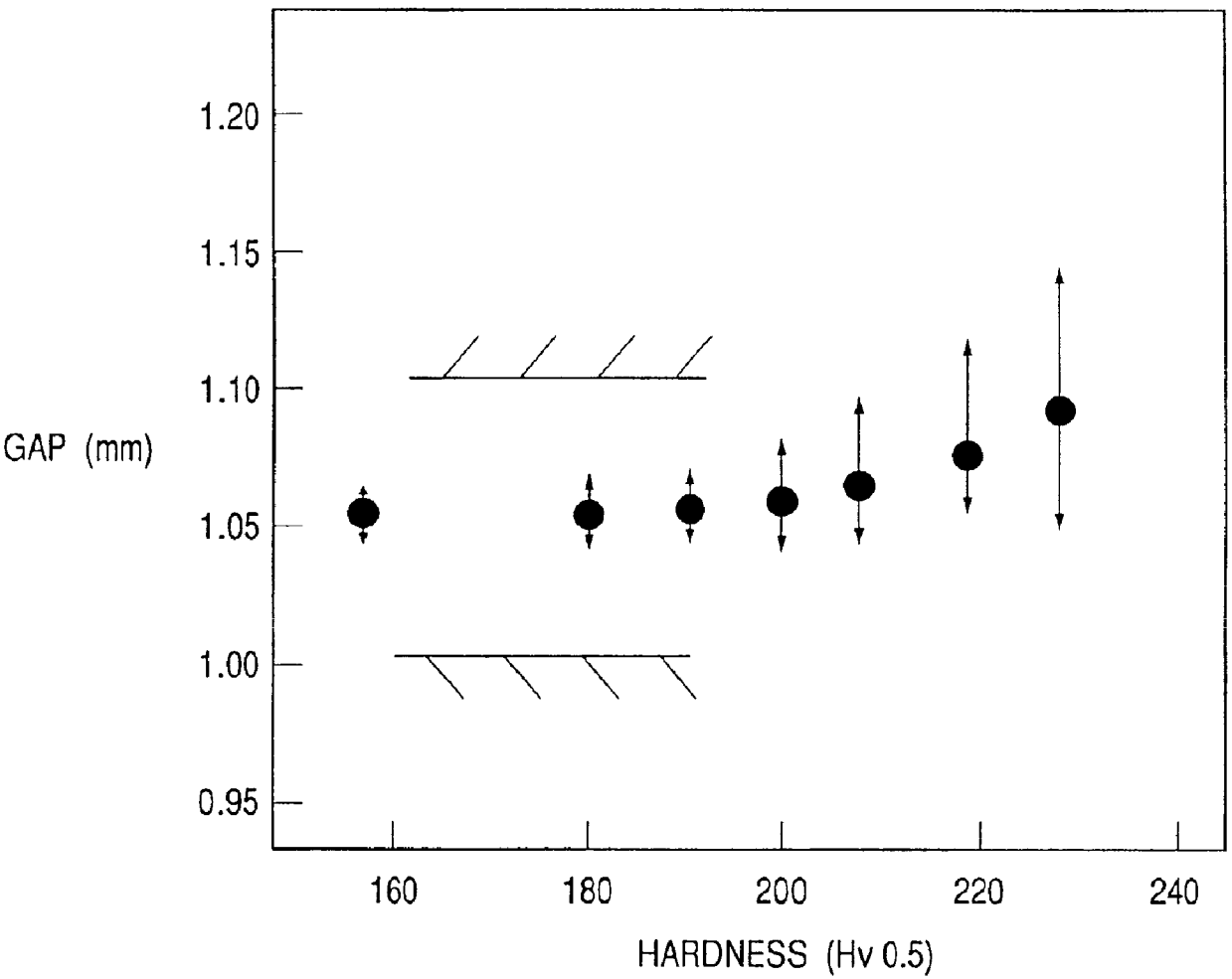
FIG. 13 is a graph showing the dispersion of discharge gap in the relationship with the hardness of electrode base material.

FIG. 13 shows the dispersion of discharge gap in the relationship with the hardness of electrode base material. It is understood that the discharge gap can be accurately formed when the hardness (Hv0.5) of the electrode base material is equal to or less than 210. The discharge gas can be more accurately formed when the hardness (Hv0.5) of the electrode base material is equal to or larger than 190. In other words, the electrode base material having the hardness in above-described range brings excellent workability.

In this embodiment, the hardness is measured at a portion of the electrode base material which has not been deformed by a bending work (in other words, a portion of the electrode base material which has not been subjected to work hardening).

State of Oxidation of Electrode Base Material

The spark plug S1 may be used in a high-temperature environment exceeding 1,000° C. which gives severe influence to the heat and oxidation resistance properties of the electrode base material as well as to the bonding strength between the electrode base material and the noble metallic tip. Thus, when the spark plug S1 is used in such a high-temperature environment, it is necessary to form the surficial oxide film on the surface of the electrode base material and the inner oxide layer inside the electrode base material within a short time (approximately 1 hour).

Furthermore, according to the inventors, to block advancement of oxidation, it is necessary to protect or maintain the surficial oxide film and the inner oxide layer against a thermal stress generating in response to repetitive temperature changes from 300° C. or less to 1,000° C. or above (more than 100 cycles).

In view of the above, it is desirable that the electrode base material for the spark plug S1 can surely form the surficial oxide layer and the inner oxide layer when the electrode base material is exposed to an atmospheric environment where the temperature repetitively changes from 300° C. or less to 1,000° C. or above at least 100 times and the electrode base material is kept at a temperature level equal to or larger than 1,000° C. for a cumulative time equal to or exceeding 1 hour.

In this respect, it is desirable that the electrode base materials 30 and 40 are made of an alloy containing Ni as a chief element and at least two kinds of additive elements including Cr and Al each having a standard free energy of formation smaller than that of Ni. For example, a preferable electrode base material is a Ni-base alloy containing NCF600 as a chief component and Al as an additive component, as described above.

As a practical example, the above-described Ni-base alloy containing NCF600 and Al was used to manufacture the electrode base materials 30 and 40. And, the electrode base materials 30 and 40 were subjected to 100 cycles of a temperature cycle test consisting of a 1,050° C. environment (3 minutes) and a room temperature environment (3 minutes).

Figure 14:
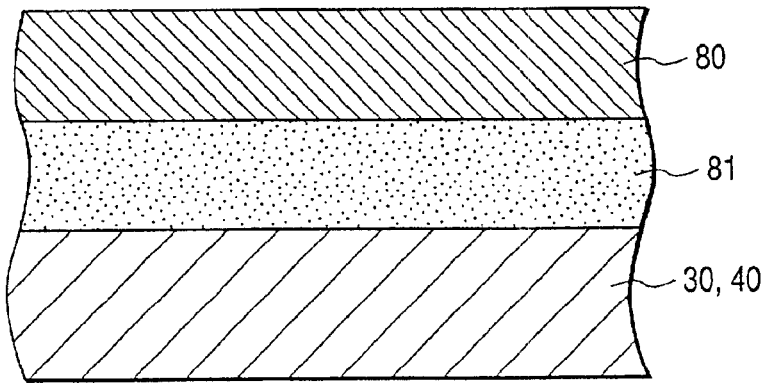
FIG. 14 is an enlarged cross-sectional view schematically showing a surficial film arrangement consisting of a chromium oxide and an aluminum oxide formed on the surface of the electrode base material when subjected to repetitive temperature cycles.

After finishing the above-described repetitive temperature cycle test, as shown in FIG. 14, a chromium oxide $Cr_2O_3$ film (i.e., surficial oxide film) 80 is formed on the surface of electrode base materials 30 and 40 and an aluminum oxide $Al_2O_3$ layer (i.e., inner oxide layer) 81 is formed beneath the surficial oxide film 80.

In this manner, the heat and oxidation resistance properties of the electrode base material as well as the bonding strength between the electrode base material and the noble metallic tip can be maintained at practically acceptable levels always when the chromium oxide is formed on the surface of the electrode base material and the aluminum oxide is formed beneath the chromium oxide under the condition that the electrode base material is subjected to the above-described environmental changes.

Furthermore, formation of the chromium oxide serving as the surficial oxide film and the aluminum oxide serving as the inner oxide layer gradually advances in accordance with the use of electrode in such a high-temperature environment. Therefore, if an additive amount of each additive element is adequately adjusted, there will be no problem in the initial working or machining condition for the electrode base material. Furthermore, there is no necessity of changing the composition of noble metallic tip. This makes it possible to adequately maintain the anti-exhaustion properties of the noble metallic tip.

Accordingly, as long as the chromium oxide and the aluminum oxide are surely formed when the electrode base material is subjected to the above-described environmental changes, it becomes possible to provide a spark plug which is capable of assuring the anti-exhaustion properties of the noble metallic tip and the workability of the electrode base material and also assuring an excellent bonding strength between the electrode base material and the noble metallic tip,.

Actually, in the same manner as in the evaluation described with reference to FIGS. 4 and 5, good result was obtained in the evaluation of workability, heat and oxidation resistance properties, and tip bondability which was performed on the example of the electrode base material relating to the above-described temperature cycle.

Furthermore, it is not always required to form a complete flat film consisting of $Cr_2O_3$ film (i.e., surficial oxide film) 80 and $Al_2O_3$ layer (i.e., inner oxide layer) 81. It is thus acceptable that each of film 80 and layer 81 has a portion not being oxidized.

The above-described effects can be obtained always when the chromium oxide 80 and aluminum oxide 81 are formed at least around the noble metallic tips 50 and 60 on the electrode base materials 30 and 40. FIGS. 15 and 16 show examples of ground electrodes 40 formed by the electrode base material of this embodiment.

Figure 15A:
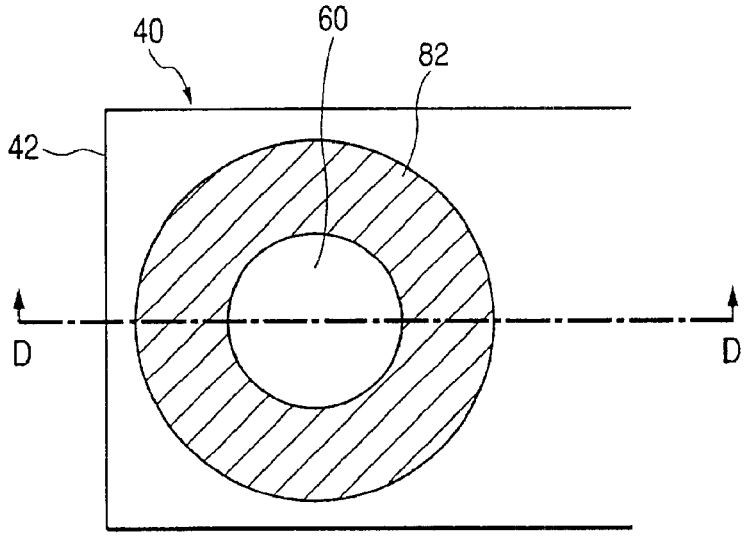
FIG. 15A is a plan view showing a surficial film consisting of a chromium oxide and an aluminum oxide formed in an outer peripheral region of the noble metallic tip when the noble metallic tip is fixed to the ground electrode by resistance welding.
Figure 15B:
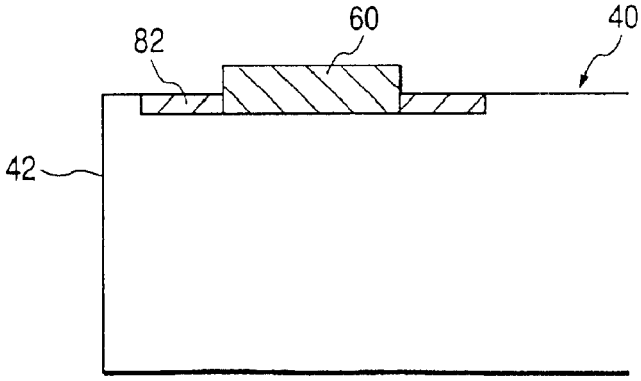
FIG. 15B is a schematic cross-sectional view showing the surficial film taken along a line D—D of FIG. 15A.
Figure 16A:
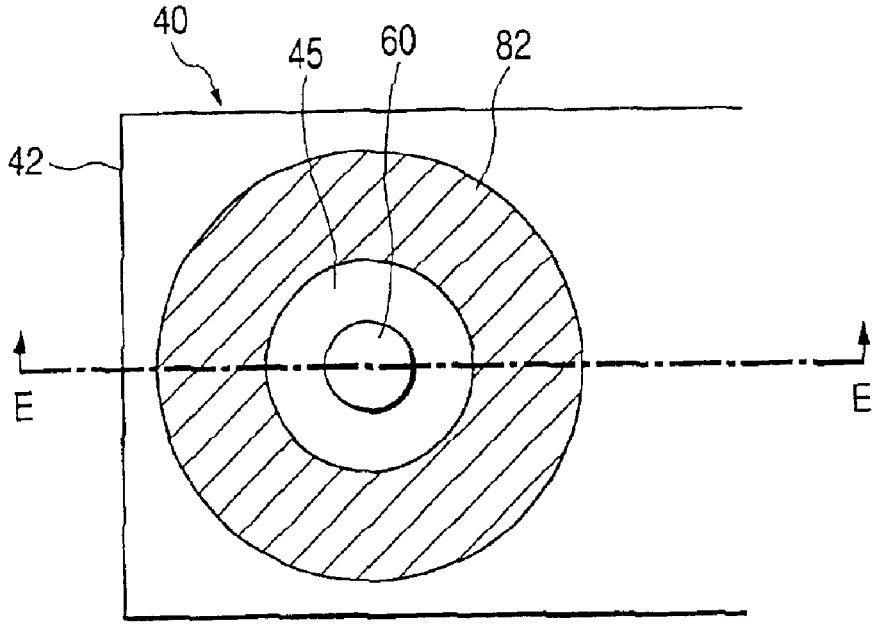
FIG. 16A is a plan view showing a surficial film consisting of a chromium oxide and an aluminum oxide formed in an outer peripheral region of the noble metallic tip when the noble metallic tip is fixed to the ground electrode by laser welding.
Figure 16B:
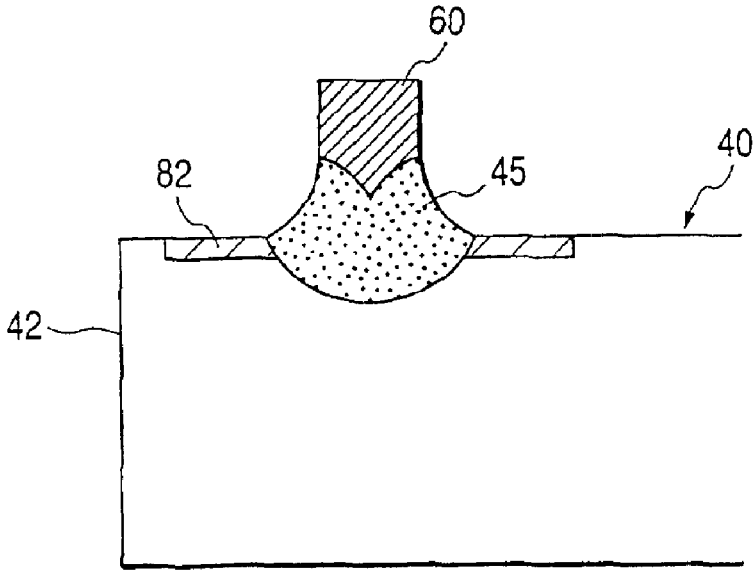
FIG. 16B is a schematic cross-sectional view showing the surficial film taken along a line E—E of FIG. 16A.

FIG. 15 shows an example using the resistance welding for fixing the noble metallic tip (i.e., ground electrode tip) 60 to the distal portion 42 of ground electrode 40. FIG. 16 shows an example using the laser welding. FIG. 15A is a plan view showing the noble metallic tip 60 and its vicinity seen from the direction normal to the noble metallic tip bonding surface, FIG. 15B is a schematic cross-sectional view showing the noble metallic tip 60 and its vicinity taken along a line D—D of FIG. 15A. FIG. 16A is a plan view showing the noble metallic tip 60 and its vicinity seen from the direction normal to the noble metallic tip bonding surface, FIG. 16B is a schematic cross-sectional view showing the noble metallic tip 60 and its vicinity taken along a line E—E of FIG. 16A.

In each case, a surficial film 82 consisting of the above-described chromium oxide and aluminum oxide (corresponding to a multi-layer of $Cr_2O_3$ film 80 and $Al_2O_3$ layer 81 shown in FIG. 14) is formed in the outer peripheral region of the noble metallic tip 60 according to the example shown in FIG. 15 or in the outer peripheral region of the fused portion 45 according to the example shown in FIG. 16.

As shown in FIGS. 15 and 16, the outer peripheral region of noble metallic tip 60 is a portion of ground electrode (i.e., electrode base material) 40 in the vicinity of a bonding surface between the noble metallic tip and the electrode base material including the fused portion. It is required that the surficial film 82 is formed in the outer peripheral region of noble metallic tip under the condition the electrode base material is subjected to the above-described environmental changes.

It is needless to say that the above-described method for fixing the noble metallic tip to the ground electrode can be directly applied to the electrode base material (i.e., ground electrode) 40 shown in FIGS. 15 and 16.

The present invention can be applied to a spark plug which has only one noble metallic tip fixed to either the center electrode or the ground electrode. Furthermore, the present invention can be applied to a spark plug having a plurality of ground electrodes on which noble metallic tips are fixed respectively. Furthermore, the present invention does not limit the layout or shape of the electrodes and the noble metallic tips.

Figure 17A:
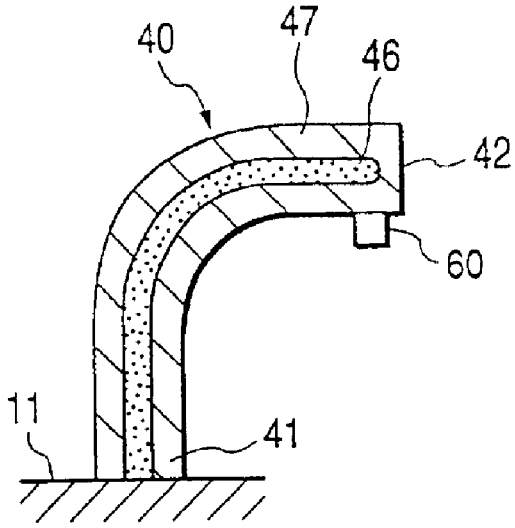
FIG. 17A is a cross-sectional view showing a spark plug in accordance with another embodiment of the present invention.
Figure 17B:
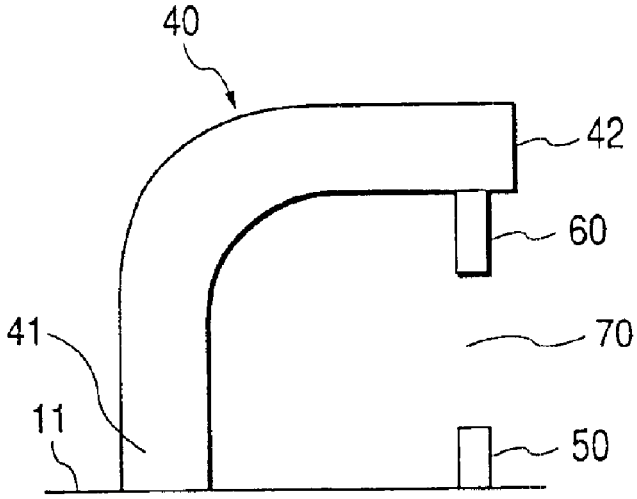
FIG. 17B is a side view showing the spark plug shown in FIG. 17A.

Furthermore, the electrode base material of the present invention can be applied to a spark plug having an electrode arrangement shown in FIGS. 17A and 17B. FIG. 17A is a schematic cross-sectional view showing the ground electrode 40 which comprises a core member 46 made of Cu, Ni or the like positioned at an inner portion and a cover member 47 entirely surrounding the core member 46. In this case, the cover member 47 serving as an outer layer is made of the electrode base material.

Furthermore, FIG. 17B shows a side view showing a discharge portion. The noble metallic tip 60 fixed to the distal portion 42 of ground electrode 40 (i.e., the electrode base material) is extended toward the center electrode 30 (for example, by an amount of 1 mm) compared with a conventional one, so as to improve heat radiation properties.

In this case, the ground electrode 40 becomes longer by an extended amount of noble metallic tip 60. Its heat resistance must be maintained appropriately. Such a requirement can be easily satisfied by adopting the electrode base material having above-described arrangement.

What is claimed is:

1. A spark plug comprising:

a center electrode;

an insulator for holding said center electrode;

a housing for fixedly holding said insulator;

a ground electrode having a proximal portion fixed to said housing and a distal portion opposing said center electrode; and a noble metallic tip fixed to an electrode base material serving as at least one of said center electrode and said ground electrode, wherein said electrode base material is an alloy containing nickel (Ni) as a chief element whose content is largest in said alloy and a plurality of additive elements, at least two kinds of additive elements contained in said alloy are chromium (Cr) and aluminum (Al), and an additive amount of said chromium is in a range from 10 to 20 weight %, and an additive amount of said aluminum is in a range from 1.5 to 5.5 weight %.

2. The spark plug in accordance with claim 1, wherein the additive amount of said aluminum is in a range from 2.2 to 5.0 weight %.

3. The spark plug in accordance with claim 1, wherein said electrode base material contains Fe whose additive amount is larger than the additive amount of said aluminum.

4. The spark plug in accordance with claim 3, wherein a total amount of elements other than said chief element, said chromium, and said aluminum is equal to or less than 20 weight %.

5. The spark plug in accordance with claim 4, wherein a portion of said electrode base material has a hardness (Hv0.5) equal to or less than 210.

6. The spark plug in accordance with claim 4, wherein a portion of said electrode base material has a hardness (Hv0.5) equal to or less than 190.

7. The spark plug in accordance with claim 1, wherein said noble metallic tip is made of a platinum alloy including Pt as a chief component and at least one additive component selected from the group consisting of iridium (Ir), nickel (Ni), rhodium (Rh), tungsten (W), palladium (Pd), ruthenium (Ru) and osmium (Os).

8. The spark plug in accordance with claim 1, wherein a material for said noble metallic tip is a platinum alloy containing Pt as a chief component and at least one additive component selected from the group consisting of Ir (50 weight% or less), Ni (40 weight% or less), Rh (50 weight% or less), W (30 weight% or less), Pd (40 weight% or less), Ru (30 weight% or less) and Os (20 weight% or less).

9. The spark plug in accordance with claim 1, wherein said noble metallic tip is made of an iridium alloy including Ir as a chief component and at least one additive component selected from the group consisting of rhodium (Rh), platinum (Pt), nickel (Ni), tungsten (W), palladium (Pd), ruthenium (Ru) and osmium (Os).

10. The spark plug in accordance with claim 1, wherein a material for said noble metallic tip is an iridium alloy containing Ir as a chief component and at least one additive component selected from the group consisting of Rh (50 weight% or less), Pt (50 weight% or less), Ni (40 weight% or less), W (30 weight% or less), Pd (40 weight% or less), Ru (30 weight% or less) and Os (20 weight% or less).

11. A spark plug comprising:

a center electrode;

an insulator for holding said center electrode;

a housing for fixedly holding said insulator;

a ground electrode having a proximal portion fixed to said housing and a distal portion opposing said center electrode; and a noble metallic tip fixed to an electrode base material serving as at least one of said center electrode and said ground electrode, wherein said electrode base material contains NCF600, which comprises 72% Ni, 14–17% Cr, 6–10% Fe, 1% Mn, 0.50% Si, 0.50% Cu, 0.15% C, 0.030% P, 0.015% S, as a chief component and aluminum (Al) as an additive component.

12. The spark plug in accordance with claim 11, wherein an additive amount of said aluminum is in a range from 1.5 to 5.5 weight %.

13. The spark plug in accordance with claim 12, wherein an additive amount of said aluminum is in a range from 2.2 to 5.0 weight %.

14. The spark plug in accordance with claim 12, wherein a portion of said electrode base material has a hardness (Hv0.5) equal to or less than 210.

15. The spark plug in accordance with claim 12, wherein a portion of said electrode base material has a hardness (Hv0.5) equal to or less than 190.

16. A spark plug comprising:

a center electrode;

an insulator for holding said center electrode;

a housing for fixedly holding said insulator;

a ground electrode having a proximal portion fixed to said housing and a distal portion opposing said center electrode; and a noble metallic tip fixed to an electrode base material containing Cr and Al as an additive component and serving as at least one of said center electrode and said ground electrode; and a chromium oxide formed on a surface of said electrode base material, and an aluminum oxide formed beneath said chromium oxide, after said electrode base material is exposed to an atmospheric environment where the temperature repetitively changes from 300°C. or less to 1,000°C. or above at least 100 times and the electrode base material is kept at a temperature level equal to or larger than 1,000°C. for a cumulative time equal to or exceeding 1 hour.

17. The spark plug in accordance with claim 16, wherein said chromium oxide and said aluminum oxide of said electrode base material are formed in an outer peripheral region of said noble metallic tip.

18. The spark plug in accordance with claim 16, wherein said noble metallic tip is made of a platinum alloy including Pt as a chief component and at least one additive component selected from the group consisting of iridium (Ir), nickel (Ni), rhodium (Rh), tungsten (W), palladium (Pd), ruthenium (Ru) and osmium (Os).

19. The spark plug in accordance with claim 18, wherein a material for said noble metallic tip is a platinum alloy containing Pt as a chief component and at least one additive component selected from the group consisting of Ir (50 weight% or less), Ni (40 weight% or less), Rh (50 weight% or less), W (30 weight% or less), Pd (40 weight% or less), Ru (30 weight% or less) and Os (20 weight% or less).

20. The spark plug in accordance with claim 16, wherein said noble metallic tip is made of an iridium alloy including Ir as a chief component and at least one additive component selected from the group consisting of rhodium (Rh), platinum (Pt), nickel (Ni), tungsten (W), palladium (Pd), ruthenium (Ru) and osmium (Os).

21. The spark plug in accordance with claim 20, wherein a material for said noble metallic tip is an iridium alloy containing Ir as a chief component and at least one additive component selected from the group consisting of Rh (50 weight% or less), Pt (50 weight% or less), Ni (40 weight% or less), W (30 weight% or less), Pd (40 weight% or less), Ru (30 weight% or less) and Os (20 weight% or less).

* * * * *